US012054690B2

(12) United States Patent
Watanabe

(10) Patent No.: US 12,054,690 B2
(45) **Date of Patent: *Aug. 6, 2024**

(54) GREASE COMPOSITION

(71) Applicant: IDEMITSU KOSAN CO., LTD., Chiyoda-ku (JP)

(72) Inventor: Go Watanabe, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/907,371

(22) PCT Filed: Mar. 16, 2021

(86) PCT No.: PCT/JP2021/010665
§ 371 (c)(1),
(2) Date: Sep. 26, 2022

(87) PCT Pub. No.: WO2021/200125
PCT Pub. Date: Oct. 7, 2021

(65) Prior Publication Data

US 2023/0124121 A1 Apr. 20, 2023

(30) Foreign Application Priority Data

Mar. 31, 2020 (JP) ..... 2020-065439

(51) Int. Cl.
*C10M 169/00* (2006.01)
*C10M 107/08* (2006.01)
(Continued)

(52) U.S. Cl.
CPC ..... *C10M 169/00* (2013.01); *C10M 107/08* (2013.01); *C10M 115/08* (2013.01);
(Continued)

(58) Field of Classification Search
CPC ..... C10M 169/00; C10M 107/08; C10M 115/08; C10M 129/40; C10M 133/16;
(Continued)

(56) References Cited

U.S. PATENT DOCUMENTS

2004/0198617 A1 10/2004 Kinoshita et al.
2010/0105585 A1* 4/2010 Carey ..... C10M 169/04 252/400.21

(Continued)

FOREIGN PATENT DOCUMENTS

CN 110914389 A 3/2020
EP 3031888 A1 6/2016

(Continued)

OTHER PUBLICATIONS

Combined Chinese Office Action and Search Report issued Nov. 10, 2023 in Chinese Patent Application No. 202180024774.6 (with unedited computer-generated English Translation), 12 pages.

(Continued)

*Primary Examiner* — Taiwo Oladapo
(74) *Attorney, Agent, or Firm* — Oblon, McClelland, Maier & Neustadt, L.L.P.

(57) ABSTRACT

A grease composition which contains a base oil (A), a urea-based thickener (B), a sarcosine derivative (C), and a fatty acid zinc salt (D), wherein particles containing the urea-based thickener (B) in the grease composition satisfies Requirement (I). The base oil (A) is a blended base oil containing a high viscosity hydrocarbon-based synthetic oil having a specific kinematic viscosity (A1). A low viscosity hydrocarbon-based synthetic oil having a specific kinematic viscosity (A2). An ultra-high viscosity hydrocarbon-based synthetic oil has a number average molecular weight (Mn) of 2,500 to 4,500 and a specific kinematic viscosity (A3). A 40° C. kinematic viscosity of the base oil (A) is 500 $mm^2/s$ (Continued)

to 1,500 $mm^2/s$. A viscosity index of the base oil (A) is 140 or more. A content of the fatty acid zinc salt (D) is 10 mass % to 20 mass % based on a total amount of the grease composition.

20 Claims, 6 Drawing Sheets

(51) Int. Cl.

| | |
|---|---|
| ***C10M 115/08*** | (2006.01) |
| ***C10M 129/40*** | (2006.01) |
| ***C10M 133/16*** | (2006.01) |
| ***C10M 141/06*** | (2006.01) |
| *C10N 20/02* | (2006.01) |
| *C10N 20/04* | (2006.01) |
| *C10N 20/06* | (2006.01) |
| *C10N 30/02* | (2006.01) |
| *C10N 50/10* | (2006.01) |

(52) U.S. Cl.
CPC ..... *C10M 129/40* (2013.01); *C10M 133/16* (2013.01); *C10M 141/06* (2013.01); *C10M 2205/0206* (2013.01); *C10M 2205/0265* (2013.01); *C10M 2207/126* (2013.01); *C10M 2215/1026* (2013.01); *C10M 2215/28* (2013.01); *C10N 2020/02* (2013.01); *C10N 2020/04* (2013.01); *C10N 2020/06* (2013.01); *C10N 2030/02* (2013.01); *C10N 2050/10* (2013.01)

(58) Field of Classification Search
CPC ..... C10M 141/06; C10M 2205/0206; C10M 2205/0265; C10M 2207/126; C10M 2215/1026; C10M 2215/28; C10M 169/02; C10M 2205/026; C10M 2205/0285; C10M 2207/125; C10M 2215/04; C10N 2020/02; C10N 2020/04; C10N 2020/06; C10N 2030/02; C10N 2050/10; C10N 2020/055; C10N 2030/06
See application file for complete search history.

(56) References Cited

U.S. PATENT DOCUMENTS

| | | | |
|---|---|---|---|
| 2018/0037842 | A1 | 2/2018 | Suetsugu et al. |
| 2019/0194566 | A1 | 6/2019 | Kim |
| 2020/0181528 | A1 | 6/2020 | Kochi et al. |

FOREIGN PATENT DOCUMENTS

| | | | |
|---|---|---|---|
| JP | 2008-163216 | A | 7/2008 |
| WO | WO 03/006590 | A1 | 1/2003 |
| WO | WO 2016/104010 | A1 | 6/2016 |
| WO | WO 2016/125859 | A1 | 8/2016 |
| WO | WO 2017/126703 | A1 | 7/2017 |
| WO | WO 2017/146257 | A1 | 8/2017 |
| WO | WO 2018/043744 | A1 | 3/2018 |
| WO | WO 2018/092806 | A1 | 5/2018 |
| WO | WO 2018/203542 | A1 | 11/2018 |
| WO | WO 2020/179589 | A1 | 9/2020 |

OTHER PUBLICATIONS

European Office Action issued on Mar. 6, 2024 in European Patent Application No. 21778893.4, 6 pages.

* cited by examiner

GREASE COMPOSITION

CROSS REFERENCE TO RELATED APPLICATIONS

This application is a National Stage entry under 35 U.S.C. § 371 of PCT/JP2021/010665, filed on Mar. 16, 2021, and claims priority to Japanese Patent Application No. 2020-065439, filed on Mar. 31, 2020, the entire contents of which are incorporated herein by reference.

TECHNICAL FIELD

The present invention relates to a grease composition.

BACKGROUND ART

A grease composition is easy to achieve sealing as compared with lubricating oils and is able to achieve downsizing and weight reduction of a machine to be applied. Accordingly, the grease composition has hitherto been widely used for lubrication of a variety of sliding portions of automobiles, electrical machinery and appliances, industrial machinery, industrial machines, and so on.

For example, in automobiles, a ball joint constituted by a metal material and a resin material is used for linking a link mechanism of a suspension and linking a link mechanism of a steering, and when vibration is caused by repeating of adhesion and sliding of frictional surfaces generated between the frictional surfaces, namely, stick slip, it significantly affects the ride quality of an automobile. Therefore, a lubricant for use in a ball joint is required to be able to suppress stick slip besides having a low friction property.

As lubricants for use in a ball joint constituted by steel, which is an example of a metal material, and a resin such as polyoxymethylene, grease compositions and solid lubricants are known.

As a grease composition based on use in a ball joint, etc., for example, PTL 1 discloses a grease composition using a urea-based thickener, in which oil release is small at a high temperature and which has a lubrication performance.

CITATION LIST

Patent Literature

PTL 1: JP 2009-293042 A

SUMMARY OF INVENTION

Technical Problem

Here, grease compositions used in automobiles are used in a wide temperature range from about −40° C., which is an outer air temperature before activation of an engine in winter, to about 80° C., which is in an engine room in summer.

However, the grease composition of PTL 1 has not been considered at all for the performance (low temperature property) of the grease composition at low temperatures.

Furthermore, as lubricants for use in the above-mentioned ball joint, solid lubricants such as amide compounds are known.

However, solid lubricants such as amide compounds have excellent starting torque and rotating torque at about ordinary temperature (40° C.), but are solidified at low temperatures (−40° C.) and do not function as solid lubricants.

Furthermore, solid lubricants do not function as solid lubricants also at high temperatures (80° C. or more) due to melting. That is, there is a problem that solid lubricants such as amide compounds are poor in temperature property.

Therefore, the present invention aims at providing a grease composition having an excellent low temperature property and further capable of suppressing stick slip.

Solution to Problem

In a grease composition containing a base oil and a urea-based thickener, the present inventor paid attention to a particle diameter of particles containing the urea-based thickener in the grease composition. Then, it has been found that a grease composition in which the foregoing particles are regulated such that an arithmetic average particle diameter on an area basis as measured by the laser diffraction/scattering method falls within a specified range, and a grease composition containing a specific base oil, a specific sarcosine derivative and a specific fatty acid zinc acid is able to solve the aforementioned problem, thereby leading to accomplishment of the present invention.

Specifically, the present invention relates to the following [1] to [15].

[1] A grease composition containing a base oil (A), a urea-based thickener (B), a sarcosine derivative (C), and a fatty acid zinc salt (D), wherein particles containing the urea-based thickener (B) in the grease composition satisfies the following requirement (I):

Requirement (I): an arithmetic average particle diameter of the particles on an area basis as measured by the laser diffraction/scattering method is 2.0 μm or less, and the base oil (A) is a blended base oil containing a high viscosity hydrocarbon-based synthetic oil having a 40° C. kinematic viscosity of 200 $mm^2/s$ to 600 $mm^2/s$ (A1), a low viscosity hydrocarbon-based synthetic oil having a 40° C. kinematic viscosity of 5.0 to 110 $mm^2/s$ (A2), and an ultra-high viscosity hydrocarbon-based synthetic oil having a number average molecular weight (Mn) of 2,500 to 4,500 and a 40° C. kinematic viscosity of 25,000 to 50,000 $mm^2/s$ (A3), a 40° C. kinematic viscosity of the base oil (A) is 500 $mm^2/s$ to 1,500 $mm^2/s$, a viscosity index of the base oil (A) is 140 or more, and a content of the fatty acid zinc salt (D) is 10 mass % to 20 mass % based on a total amount of the grease composition.

[2] The grease composition of [1], wherein the particles containing the urea-based thickener (B) in the grease composition further satisfies the following requirement (II):

Requirement (II): a specific surface area of the particles as measured by the laser diffraction/scattering method is $0.5\times10^5$ $cm^2/cm^3$ or more.

[3] The grease composition of [1] or [2], wherein a content ratio [(C)/(D)] of the sarcosine derivative (C) to the fatty acid zinc salt (D) is 0.03 to 0.3 by mass ratio.

[4] The grease composition of [1] to [3], wherein the sarcosine derivative (C) contains N-oleoylsarcosine.

[5] The grease composition of [1] to [4], wherein the fatty acid zinc salt (D) contains zinc stearate.

[6] The grease composition of [1] to [5], wherein a content ratio [(B)/(D)] of the urea-based thickener (B) to the fatty acid zinc salt (D) is 0.1 to 0.6 by mass ratio.

[7] The grease composition of [1] to [6], wherein a content of the urea-based thickener (B) is 1.0 mass % to 15.0 mass % based on a total amount of the grease composition, and a worked penetration is 265 to 340.

[8] The grease composition of [1] to [7], wherein the content of the high viscosity hydrocarbon-based synthetic oil (A1) is 25 mass % to 55 mass %, the content of the low viscosity hydrocarbon-based synthetic oil (A2) is 5 mass % to 35 mass %, and the content of the ultra-high viscosity hydrocarbon-based synthetic oil (A3) is 5 mass % to 30 mass %, based on a total amount of the grease composition.

[9] The grease composition of [1] to [8], wherein a content ratio [(A1)/(A2)] of the high viscosity hydrocarbon-based synthetic oil (A1) to the low viscosity hydrocarbon-based synthetic oil (A2) is 0.5 to 12 by mass ratio.

[10] The grease composition of [1] to [9], wherein a content ratio [(A3)/(A2)] of the low viscosity hydrocarbon-based synthetic oil (A3) to the ultra-high viscosity hydrocarbon-based synthetic oil (A2) is 1.0 to 10 by a mass ratio.

[11] The grease composition of [1] to [10], wherein a content ratio [(A1)/(A3)] of the high viscosity hydrocarbon-based synthetic oil (A1) to the ultra-high viscosity hydrocarbon-based synthetic oil (A3) is 1.0 to 11 by a mass ratio.

[12] The grease composition of [1] to [11], which is used for lubrication of a sliding mechanism in which a metal material and a resin material are slid.

[13] The grease composition of [12], wherein the sliding mechanism is a ball joint having a ball stud made of a metal, a housing, and a ball sheet made of a resin disposed between the ball stud and the housing.

[14] A method for lubricating a sliding mechanism in which a metal material and a resin material are slid by the grease composition of [1] to [13].

[15] The lubrication method of [14], wherein the sliding mechanism is a ball joint having a ball stud made of a metal, a housing, and a ball sheet made of a resin disposed between the ball stud and the housing.

Advantageous Effects of Invention

According to the present invention, it becomes possible to provide a grease composition having an excellent low temperature property and further capable of suppressing stick slip.

DESCRIPTION OF EMBODIMENTS

Figure 1:
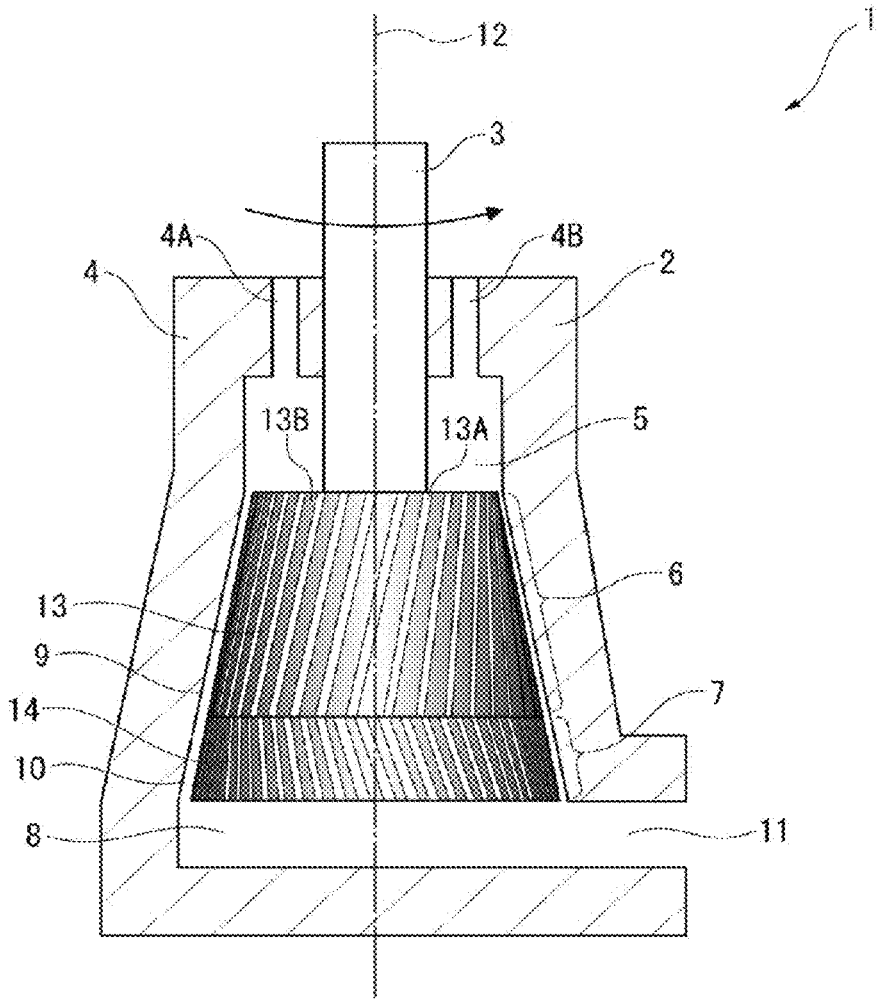
FIG. 1 is a schematic cross-sectional view of a grease manufacturing apparatus which can be used in one embodiment of the present invention.

In this specification, regarding a preferred numerical value range (for example, a range of the content, etc.), a lower limit value and an upper limit value that are expressed in stages can be combined each independently. For example, from an expression of "preferably 10 to 90, and more preferably 30 to 60", by combining the "preferred lower limit value (10)" and the "more preferred upper limit value (60)", a suitable range can also be conceived as "10 to 60".

In this specification, the numerical values in the Examples are a numerical value used as an upper limit value or a lower limit value.

[Grease Composition]

The grease composition of the present invention is a grease composition containing a base oil (A), a urea-based thickener (B), a sarcosine derivative (C), and a fatty acid zinc salt (D), wherein particles containing the urea-based thickener (B) in the grease composition satisfies the following requirement (I), the base oil (A) is a blended base oil containing a high viscosity hydrocarbon-based synthetic oil having a 40° C. kinematic viscosity of 200 $mm^2/s$ to 600 $mm^2/s$ (A1), a low viscosity hydrocarbon-based synthetic oil having a 40° C. kinematic viscosity of 5.0 to 110 $mm^2/s$ (A2), and an ultra-high viscosity hydrocarbon-based synthetic oil having a number average molecular weight (Mn) of 2,500 to 4,500 and a 40° C. kinematic viscosity of 25,000 to 50,000 $mm^2/s$ (A3), a 40° C. kinematic viscosity of the base oil (A) is 500 $mm^2/s$ to 1,500 $mm^2/s$, a viscosity index of the base oil (A) is 140 or more, and a content of the fatty acid zinc salt (D) is 10 mass % to 20 mass % based on a total amount of the grease composition.

Requirement (I): an arithmetic average particle diameter of the particles on an area basis as measured by the laser diffraction/scattering method is 2.0 μm or less.

In the following description, the "base oil (A)", the "urea-based thickener (B)", the "sarcosine derivative (C)", and the "fatty acid zinc salt (D)" are also referred to as "component (A)", "component (B)", "component (C)", and "component (D)", respectively.

In the grease composition of one embodiment of the present invention, the total content of the components (A), (B), (C) and (D) is preferably 60% by mass or more, more preferably 70% by mass or more, still more preferably 80% by mass or more, yet still more preferably 90% by mass or more. In addition, it is typically 100% by mass or less, preferably less than 100% by mass, more preferably 99% by mass or less, and still more preferably 98% by mass or less.

The grease composition of one embodiment of the present invention can contain components other than the components (A), (B), (C) and (D) within a range where the effects of the present invention are not impaired.

<Requirement (I)>

In the grease composition of the present invention, the particles containing the urea-based thickener (B) satisfies the following requirement (I).

Requirement (I): an arithmetic average particle diameter of the particles on an area basis as measured by the laser diffraction/scattering method is 2.0 μm or less.

A grease composition having an excellent low temperature property is obtained by satisfying the above-mentioned requirement (I).

The requirement (I) can also be said to be a parameter expressing a state of aggregation of the urea-based thickener (B) in the grease composition.

Here, the term "particles containing the urea-based thickener (B)" as an object for measurement by the laser diffraction/scattering method refers to particles in which the urea-based thickener (B) contained in the grease composition aggregates.

In the case where an additive other than the urea-based thickener (B) is contained in the grease composition, the particle diameter prescribed in the requirement (I) can be obtained through measurement of a grease composition prepared under the same conditions without being blended with the foregoing additive by the laser diffraction/scattering method. However, in the case where the foregoing additive is liquid at room temperature (25° C.), or in the case where the additive is dissolved in the base oil (A), it does not matter if a grease composition having the additive blended therein is an object for measurement.

The urea-based thickener (B) is typically obtained by reacting an isocyanate compound with a monoamine. However, since the reaction rate is very fast, the urea-based thickener (B) aggregates, whereby large particles (micelle particles, so-called "lumps") are liable to be formed in excess. As a result of extensive and intensive investigations made by the present inventor, it has been noted that when the particle diameter prescribed in the requirement (I) is more than 2.0 μm, in the case of increasing the worked penetration of the grease composition, the low temperature property of the grease composition cannot be secured. Namely, it has been noted that when the particle diameter prescribed in the requirement (I) is more than 2.0 μm, it is difficult to provide a grease composition having an excellent low temperature property even the specific base oil (A) mentioned below is used.

In contrast, as a result of extensive and intensive investigations made by the present inventor, it has been noted that by miniaturizing the particle diameter prescribed in the requirement (I) to an extent of 2.0 μm or less, a grease composition having an excellent low temperature property can be provided by the combination with the specific base oil (A) described below. Moreover, it has also been noted that by miniaturizing the particle diameter prescribed in the requirement (I) to an extent of 2.0 μm or less, the effects of the sarcosine derivative (C) and the fatty acid zinc salt (D) can be made excellent.

It can be guessed that this effect is brought by the fact that by miniaturizing the particle diameter prescribed in the requirement (I) to an extent of 2.0 μm or less, the particles containing the urea-based thickener (B) becomes easy to come into a lubricating site (frictional surface) such as a ball joint and are hardly removed from the lubricating site, whereby a holding power of the grease composition in the lubricating site is improved even in a case of low temperature at which the viscosity of the base oil (A) is increased. In addition, by miniaturizing the particle diameter prescribed in the requirement (I) to an extent of 2.0 μm or less, the holding power of the base oil (A) by the foregoing particles is improved. Accordingly, it can be guessed that not only the base oil (A) is spread well in the lubricating site (frictional surface) such as a ball joint, but also accompanying this, an action to spread well the sarcosine derivative (C) and the fatty acid zinc salt (D) in the lubricating site is improved, whereby the property to suppress stick slip is improved.

From the aforementioned viewpoint, in the grease composition of one embodiment of the present invention, the particle diameter prescribed in the requirement (I) is preferably 1.5 μm or less, more preferably 1.0 μm or less, still more preferably 0.9 μm or less, yet still more preferably 0.8 μm or less, even yet still more preferably 0.7 μm or less, even still more preferably 0.6 μm or less, even still yet still more preferably 0.5 μm or less, and even yet still further preferably 0.4 μm or less. In addition, it is typically 0.01 μm or more.

<Requirement (II)>

Here, it is preferred that the grease composition of one embodiment of the present invention further satisfies the following requirement (II):

Requirement (II): a specific surface area of the particles as measured by the laser diffraction/scattering method is $0.5\times10^5$ $cm^2/cm^3$ or more.

The specific surface area prescribed in the requirement (II) is a secondary index expressing a state of miniaturization of the particles containing the urea-based thickener (B) in the grease composition and presence of large particles (lumps). That is, by satisfying the requirement (I) and further satisfying the requirement (II), it is revealed that the state of miniaturization of the particles containing the urea-based thickener (B) in the grease composition is more favorable, and the presence of large particles (lumps) is more suppressed. In consequence, a grease composition having an excellent low temperature property, in which the effects of the sarcosine derivative (C) and the fatty acid zinc salt (D) are exerted easily, can be provided.

From the aforementioned viewpoint, the specific surface area prescribed in the requirement (II) is preferably $0.7\times10^5$ $cm^2/cm^3$ or more, more preferably $0.8\times10^5$ $cm^2/cm^3$ or more, still more preferably $1.2\times10^5$ $cm^2/cm^3$ or more, yet still more preferably $1.5\times10^5$ $cm^2/cm^3$ or more, even yet still more preferably $1.8\times10^5$ $cm^2/cm^3$ or more, and even still more preferably $2.0\times10^5$ $cm^2/cm^3$ or more. The specific surface area is typically $1.0\times10^6$ $cm^2/cm^3$ or less.

In this specification, the values prescribed in the requirement (I) and further the requirement (II) are values measured by the methods described in the section of Examples as mentioned later.

In addition, the values prescribed in the requirement (I) and further the requirement (II) are able to be adjusted chiefly by production conditions of the urea-based thickener (B).

The respective components which are contained in the grease composition of the present invention are hereunder described in detail while paying attention to specific means for adjusting the values prescribed in the requirement (I) and further the requirement (II).

<Base Oil (A)>

The base oil (A) contained in the grease composition of the present invention is a blended base oil containing a high viscosity hydrocarbon-based synthetic oil having a 40° C. kinematic viscosity of 200 $mm^2/s$ to 600 $mm^2/s$ (A1), a low viscosity hydrocarbon-based synthetic oil having a 40° C. kinematic viscosity of 5.0 to 110 $mm^2/s$ (A2), and an ultra-high viscosity hydrocarbon-based synthetic oil having a number average molecular weight (Mn) of 2,500 to 4,500 and a 40° C. kinematic viscosity of 25,000 to 50,000 $mm^2/s$ (A3).

As a result of extensive and intensive investigations made by the present inventor, it has been noted that a grease composition capable of improving the low temperature property of the grease composition and can further suppress stick slip by appropriately combining the high viscosity hydrocarbon-based synthetic oil (A1), the low viscosity hydrocarbon-based synthetic oil (A2), and the ultra-high viscosity hydrocarbon-based synthetic oil (A3) can be obtained.

The base oil (A) needs to have a 40° C. kinematic viscosity of 500 $mm^2/s$ to 1,500 $mm^2/s$.

In the case where the 40° C. kinematic viscosity of the base oil (A) is lower than 500 $mm^2/s$, the wear resistance and fatigue resistant lifetime, etc. of the grease composition becomes insufficient. Furthermore, in the case where the 40°

C. kinematic viscosity of the above-mentioned base oil (A) is greater than 1,500 $mm^2/s$, the low temperature torques (starting torque and rotating torque) increase, and the low temperature property becomes insufficient.

The 40° C. kinematic viscosity of (A) of the base oil (A) of one embodiment of the present invention is preferably 600 to 1,400 $mm^2/s$, more preferably 700 to 1,300 $mm^2/s$, and further preferably 900 to 1,100 $mm^2/s$.

Incidentally, it is sufficient that the 40° C. kinematic viscosity of the base oil (A), which is a blended base oil, satisfies the above-mentioned range, and the 40° C. kinematic viscosities of the respective base oils constituting the blended base oil can be out of the above-mentioned range.

The base oil (A) needs to have a viscosity index of 140 or more.

The viscosity index of the base oil (A) of the present invention is preferably 150 or more, more preferably 160 or more from the viewpoint of making the effect of the present invention exert more easily.

By the viscosity index of the base oil (A) in the above-mentioned range, the change in the kinematic viscosity of the base oil (A) accompanying the change in the temperature can be made easy to suppress, and a low temperature property and an effect to suppress stick slip can be made easy to achieve simultaneously.

The 100° C. kinematic viscosity of the base oil (A) is preferably 30 to 180 $mm^2/s$, more preferably 50 to 150 $mm^2/s$, and further preferably 80 to 120 $mm^2/s$, from the viewpoint of making the effect of the present invention exert more easily.

Incidentally, in the present specification, the 40° C. kinematic viscosity, the 100° C. kinematic viscosity, and the viscosity index means values measured or calculated in conformity with JIS K2283:2000.

<<High Viscosity Hydrocarbon-Based Synthetic Oil (A1)>>

The high viscosity hydrocarbon-based synthetic oil (A1) contributes to improvement of the wear resistance and fatigue resistant lifetime of the grease composition by maintaining the kinematic viscosity of the base oil (A) high.

Here, from the viewpoint of making the wear resistance and fatigue resistant lifetime, etc. of the grease composition easy to improve, the kinematic viscosity at 40° C. (hereinafter also referred to as "40° C. kinematic viscosity") of the high viscosity hydrocarbon-based synthetic oil (A1) is 200 $mm^2/s$ or more and 600 $mm^2/s$ or less, preferably 250 $mm^2/s$ or more and 550 $mm^2/s$ or less, more preferably 300 $mm^2/s$ or more and 500 $mm^2/s$ or less, further preferably 350 $mm^2/s$ or more and 450 $mm^2/s$ or less.

As the high viscosity hydrocarbon-based synthetic oil (A1), synthetic oils that have been conventionally used as base oils for lubricating oils can be used without specific limitation as long as they satisfy a 40° C. kinematic viscosity of 200 $m^2/s$ or more and 600 $mm^2/s$ or less.

Examples of the synthetic oil used for the high viscosity hydrocarbon-based synthetic oil include, for example, hydrocarbon-based oils, aromatic-based oils, ester-based oils, ether-based oils and GTL (Gas To Liquids)-base oils obtained by hydrogenation isomerization and dewaxing waxes produced from natural gas by the Fischer-Tropsch process etc. These can be used by one kind alone, or in combination of two or more kinds.

Examples of the hydrocarbon-based oil include a poly-α-olefin (PAO), such as normal paraffin, isoparaffin, polybutene, polyisobutylene, a 1-decene oligomer, and a cooligomer of 1-decene and ethylene; and a hydrogenated product thereof.

Examples of the aromatic oil include an alkylbenzene, such as a monoalkylbenzene and a dialkylbenzene; and an alkylnaphthalene, such as a monoalkylnaphthalene, a dialkylnaphthalene, and a polyalkylnaphthalene.

Examples of the ester-based oil include a diester-based oil, such as dibutyl sebacate, di-2-ethylhexyl sebacate, dioctyl adipate, diisodecyl adipate, ditridecyl adipate, ditridecyl glutarate, and methyl acetyl ricinolate; an aromatic ester-based oil, such as trioctyl trimellitate, tridecyl trimellitate, and tetraoctyl pyromellitate; a polyol ester-based oil, such as trimethylolpropane caprylate, trimethylolpropane pelargonate, pentaerythritol-2-ethylhexanoate, and pentaerythritol pelargonate; and a complex ester-based oil, such as an oligoester of a polyhydric alcohol with a blended fatty acid of a dibasic acid and a monobasic acid.

Examples of the ether-based oil include a polyglycol, such as polyethylene glycol, polypropylene glycol, polyethylene glycol monoether, and polypropylene glycol monoether; and a phenyl ether-based oil, such as a monoalkyl triphenyl ether, an alkyl diphenyl ether, a dialkyl diphenyl ether, pentaphenyl ether, tetraphenyl ether, a monoalkyl tetraphenyl ether, and a dialkyl tetraphenyl ether.

Among these, the hydrocarbon-based oil is preferable, and a poly-α-olefin (PAO) is more preferable.

The 100° C. kinematic viscosity of the high viscosity hydrocarbon-based synthetic oil (A1) is preferably 10 to 70 $mm^2/s$, more preferably 25 to 55 $mm^2/s$, from the viewpoint of making the effect of the present invention exert more easily.

The viscosity index of the high viscosity hydrocarbon-based synthetic oil (A1) is preferably 100 to 300, more preferably 120 to 250.

In the grease composition of one embodiment of the present invention, the content of the high viscosity hydrocarbon-based synthetic oil (A1) is preferably 35 mass % to 85 mass %, more preferably 45 mass % to 75 mass %, further preferably 50 mass % to 70 mass % based on a total amount of the base oil (A), from the viewpoint of improving the wear resistance and fatigue resistant lifetime, etc. of the grease composition.

In the grease composition of one embodiment of the present invention, the content of the high viscosity hydrocarbon-based synthetic oil (A1) is preferably 10 mass % to 70 mass %, more preferably 25 mass % to 55 mass %, further preferably 30 mass % to 50 mass % based on a total amount of the grease composition. If the content of the high viscosity hydrocarbon-based synthetic oil (A1) is within the above-mentioned range, it is easy to maintain the kinematic viscosity of the grease composition high, and it is easy to prepare a grease composition having an excellent wear resistance and an excellent fatigue resistant lifetime.

The high viscosity hydrocarbon-based synthetic oil (A1) can be used by one kind alone, or two or more kinds can be used in combination.

<<Low Viscosity Hydrocarbon-Based Synthetic Oil (A2)>>

The low viscosity hydrocarbon-based synthetic oil (A2) contributes to the securement of the low temperature property of the grease composition.

Here, the 40° C. kinematic viscosity of the low viscosity hydrocarbon-based synthetic oil (A2) is 5.0 to 110 $mm^2/s$, preferably 6.0 to 90.0 $mm^2/s$, more preferably 7.0 to 80.0 $mm^2/s$, further preferably 8.0 to 75.0 $mm^2/s$, yet still more preferably 10.0 to 70.0 $mm^2/s$, further even preferably 20.0 to 50.0 $mm^2/s$, still more preferably 25.0 to 40.0 $mm^2/s$, from the viewpoint of improving the low temperature property of the grease composition.

As the low viscosity hydrocarbon-based synthetic oil (A2), base oils that have been conventionally used as base oils for lubricating oils can be used without specific limitation as long as their 40° C. kinematic viscosities satisfy the above-mentioned range.

The 100° C. kinematic viscosity of the low viscosity hydrocarbon-based synthetic oil (A2) is preferably 2.0 to 10.0 $mm^2/s$, more preferably 4.0 to 8.0 $mm^2/s$ from the viewpoint of making the effect of the present invention exert more easily.

Incidentally, the viscosity index of the low viscosity hydrocarbon-based synthetic oil (A2) is preferably 80 or more, more preferably 90 or more, further preferably 100 or more, yet still more preferably 110 or more, yet still more preferably 120 or more, and the upper limit value is not specifically limited, but is, for example, 200.

In the grease composition of one embodiment of the present invention, from the viewpoint of making the low temperature property of the grease composition easy to ensure, the content of the low viscosity hydrocarbon-based synthetic oil (A2) is preferably 7 mass % to 35 mass %, more preferably 10 mass % to 30 mass %, further preferably 13 mass % to 20 mass % based on the whole amount of the base oil (A).

In the grease composition of one embodiment of the present invention, the content of the low viscosity hydrocarbon-based synthetic oil (A2) is preferably 3 mass % to 35 mass %, more preferably 5 mass % to 35 mass %, further preferably 5 mass % to 25 mass %, yet still more preferably 5 mass % to 20 mass %, further still preferably 8 mass % to 14 mass % based on a total amount of the grease composition, from the viewpoint of making the low temperature property of the grease composition easy to ensure.

The low viscosity hydrocarbon-based synthetic oil (A2) can be used by one kind alone, or can be used in combination of two or more kinds.

<<Ultra-High Viscosity Hydrocarbon-Based Synthetic Oil (A3)>>

In the present specification, the "ultra-high viscosity hydrocarbon-based synthetic oil" means a base oil having a number average molecular weight (Mn) of 2,500 to 4,500 and having a 40° C. kinematic viscosity of 25,000 to 50,000 $mm^2/s$.

The number average molecular weight (Mn) of the ultra-high viscosity hydrocarbon-based synthetic oil (A3) is 2,500 to 4,500, preferably 3,000 to 4,250, more preferably 3,500 to 4,500, further preferably 3,500 to 4,000.

In the present specification, the number average molecular weight (Mn) is a value in terms of standard polystyrene measured by the gel permeation chromatography (GPC) process, and specifically means a value measured by the method described in Examples.

The 40° C. kinematic viscosity of the ultra-high viscosity hydrocarbon-based synthetic oil (A3) is 25,000 to 50,000 $mm^2/s$, preferably 30,000 to 45,000 $mm^2/s$, more preferably 35,000 to 40,000 $mm^2/s$.

As the ultra-high viscosity hydrocarbon-based synthetic oil (A3), base oils that have been conventionally used as base oils for lubricating oils can be used without specific limitation as long as their 40° C. kinematic viscosities satisfy the above-mentioned range, and for example, similar base oils to the high viscosity hydrocarbon-based synthetic oil (A1) can be used.

The 100° C. kinematic viscosity of the ultra-high viscosity hydrocarbon-based synthetic oil (A3) is preferably 1,000 to 3,000 $mm^2/s$, more preferably 1,500 to 2,500 $mm^2/s$.

The viscosity index of the ultra-high viscosity hydrocarbon-based synthetic oil (A3) is preferably 150 or more, more preferably 200 or more, and still more preferably 250 or more.

In the grease composition of one embodiment of the present invention, the content of the ultra-high viscosity hydrocarbon-based synthetic oil (A3) is preferably 5 mass % to 40 mass %, more preferably 10 mass % to 30 mass %, still more preferably 15 mass % to 27 mass % based on a total amount of the base oil (A), from the viewpoint of making the effect of the present invention exert more easily.

In the grease composition of one embodiment of the present invention, the content of the ultra-high viscosity hydrocarbon-based synthetic oil (A3) is preferably 5 mass % to 30 mass %, more preferably 6 mass % to 25 mass %, still more preferably 7 mass % to 25 mass %, even yet still more preferably 10 mass % to 20 mass % based on a total amount of the grease composition, from the viewpoint of making the effect of the present invention exert more easily.

The ultra-high viscosity hydrocarbon-based synthetic oil (A3) can be used by one kind alone, or can be used in combination of two or more kinds.

The content ratio [(A1)/(A2)] of the high viscosity hydrocarbon-based synthetic oil (A1) to the low viscosity hydrocarbon-based synthetic oil (A2) is preferably 0.5 to 12, more preferably 1.0 to 7.0, still more preferably 2.0 to 5.0, even yet still more preferably 3.0 to 4.5 by mass ratio.

The content ratio [(A3)/(A2)] of the low viscosity hydrocarbon-based synthetic oil (A3) to the ultra-high viscosity hydrocarbon-based synthetic oil (A2) is preferably 0.1 to 12, more preferably 0.5 to 11, still more preferably 1.0 to 10, yet still more preferably 1.5 to 5 by mass ratio.

The content ratio [(A1)/(A3)] of the high viscosity hydrocarbon-based synthetic oil (A1) to the ultra-high viscosity hydrocarbon-based synthetic oil (A3) is preferably 1.0 to 11, more preferably 1.0 to 5.5, still more preferably 2.0 to 5.0, yet still more preferably 2.1 to 4.5 by mass ratio.

In the grease composition of one embodiment of the present invention, the content of the base oil (A) is preferably 50% by mass or more, more preferably 55% by mass or more, still more preferably 60% by mass or more, and yet still more preferably 65% by mass or more, and it is preferably 98.5% by mass or less, more preferably 97% by mass or less, still more preferably 95% by mass or less, and yet still more preferably 93% by mass or less, on the basis of the total amount (100% by mass) of the grease composition.

<Urea-Based Thickener (B)>

Although the urea-based thickener (B) which is contained in the grease composition of the present invention can be a compound having a urea bond, a diurea compound having two urea bonds is preferred, and a diurea compound represented by the following general formula (b1) is more preferred.

$$R^1—NHCONH—R^3—NHCONH—R^2 \quad (b1)$$

The urea-based thickener (B) which is used in one embodiment of the present invention can include one kind or can be a blend of two or more kinds.

In the general formula (b1), $R^1$ and $R^2$ each independently represent a monovalent hydrocarbon group having 6 to 24 carbon atoms; $R^1$ and $R^2$ can be the same as or different from each other; and $R^3$ represents a divalent aromatic hydrocarbon group having 6 to 18 carbon atoms.

Although the carbon number of the monovalent hydrocarbon group which can be selected as $R^1$ and $R^2$ in the general formula (b1) is 6 to 24, it is preferably 6 to 20, and more preferably 6 to 18.

Examples of the monovalent hydrocarbon group which can be selected as $R^1$ and $R^2$ include a saturated or unsaturated monovalent chain hydrocarbon group, a saturated or unsaturated monovalent alicyclic hydrocarbon group, and a monovalent aromatic hydrocarbon group.

Here, in $R^1$ and $R^2$ in the general formula (b1), when a content ratio of the chain hydrocarbon group is designated as an X molar equivalent, a content ratio of the alicyclic hydrocarbon group is designated as a Y molar equivalent, and a content ratio of the aromatic hydrocarbon group is designated as a Z molar equivalent, it is preferred that the following requirements (a) and (b) are satisfied.

Requirement (a):

A value of $\{[(X+Y)/(X+Y+Z)]\times 100\}$ is 90 or more (preferably 95 or more, more preferably 98 or more, and still more preferably 100).

Requirement (b):

An X/Y ratio is 0/100 (X=0, Y=100) to 100/0 (X=100, Y=0) (preferably 10/90 to 90/10, more preferably 80/20 to 20/80, and still more preferably 70/30 to 40/60).

In view of the fact that the aforementioned alicyclic hydrocarbon group, the aforementioned chain hydrocarbon group, and the aforementioned aromatic hydrocarbon group are each a group to be selected as $R^1$ and $R^2$ in the general formula (b1), the sum total of the X, Y, and Z values is 2 molar equivalents per mol of the compound represented by the general formula (b1). In addition, the values of the requirements (a) and (b) each mean an average value relative to the total amount of the group of the compounds represented by the general formula (b1), which are contained in the grease composition.

By using the compound represented by the general formula (b1), which is satisfied with the requirements (a) and (b), it is easy to provide a grease composition having an excellent low temperature property.

The X, Y, and Z values can be calculated from a molar equivalent of each amine to be used as a raw material.

As the monovalent saturated chain hydrocarbon group, there is exemplified a linear or branched alkyl group having 6 to 24 carbon atoms. Specifically, examples thereof include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, an octadecenyl group, a nonadecyl group, and an eicosyl group.

As the monovalent unsaturated chain hydrocarbon group, there is exemplified a linear or branched alkenyl group having 6 to 24 carbon atoms. Specifically, examples thereof include a hexenyl group, a heptenyl group, an octenyl group, a nonenyl group, a decenyl group, a undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, an oleyl group, a geranyl group, a farnesyl group, and a linoleyl group.

The monovalent saturated chain hydrocarbon group and the monovalent unsaturated chain hydrocarbon group each can be a linear chain or a branched chain.

Examples of the monovalent saturated alicyclic hydrocarbon group include a cycloalkyl group, such as a cyclohexyl group, a cycloheptyl group, a cyclooctyl group, and a cyclononyl group; and a cycloalkyl group substituted with an alkyl group having 1 to 6 carbon atoms (preferably a cyclohexyl group substituted with an alkyl group having 1 to 6 carbon atoms), such as a methylcyclohexyl group, a dimethylcyclohexyl group, an ethylcyclohexyl group, a diethylcyclohexyl group, a propylcyclohexyl group, an isopropylcyclohexyl group, a 1-methyl-propylcyclohexyl group, a butylcyclohexyl group, a pentylcyclohexyl group, a pentyl-methylcyclohexyl group, and a hexylcyclohexyl group.

Examples of the monovalent unsaturated alicyclic hydrocarbon group include a cycloalkenyl group, such as a cyclohexenyl group, a cycloheptenyl group, and a cyclooctenyl group; and a cycloalkenyl group substituted with an alkyl group having 1 to 6 carbon atoms (preferably a cyclohexenyl group substituted with an alkyl group having 1 to 6 carbon atoms), such as a methylcyclohexenyl group, a dimethylcyclohexenyl group, an ethylcyclohexenyl group, a diethylcyclohexenyl group, and a propylcyclohexenyl group.

Examples of the monovalent aromatic hydrocarbon group include a phenyl group, a biphenyl group, a terphenyl group, a naphthyl group, a diphenylmethyl group, a diphenylethyl group, a diphenylpropyl group, a methylphenyl group, a dimethylphenyl group, an ethylphenyl group, and a propylphenyl group.

Although the carbon number of the divalent aromatic hydrocarbon group which can be selected as $R^3$ in the general formula (b1) is 6 to 18, it is preferably 6 to 15, and more preferably 6 to 13.

Examples of the divalent aromatic hydrocarbon group which can be selected as $R^3$ include a phenylene group, a diphenylmethylene group, a diphenylethylene group, a diphenylpropylene group, a methylphenylene group, a dimethylphenylene group, and an ethylphenylene group.

Of these, a phenylene group, a diphenylmethylene group, a diphenylethylene group, or a diphenylpropylene group is preferred, and a diphenylmethylene group is more preferred.

In the grease composition of one embodiment of the present invention, the content of the component (B) is preferably 1.0 to 15.0% by mass, more preferably 1.5 to 13.0% by mass, still more preferably 2.0 to 10.0% by mass, yet still more preferably 2.5 to 8.0% by mass, and even yet still more preferably 4.0 to 7.0% by mass, further preferably 4.0 to 5.0% by mass on the basis of the total amount (100% by mass) of the grease composition.

When the content of the component (B) is 1.0% by mass or more, it is easy to adjust the worked penetration of the resulting grease composition to an appropriate range.

Meanwhile, when the content of the component (B) is 15.0% by mass or less, the resulting grease composition can be adjusted soft, and therefore, it is easy to make the lubricating properties favorable, and the low temperature property is readily improved.

<Method for Producing Urea-Based Thickener (B)>

The urea-based thickener (B) can be typically obtained by reacting an isocyanate compound with a monoamine. The reaction is preferably performed by adding a solution β obtained by dissolving a monoamine in the base oil (A) to a heated solution α obtained by dissolving the isocyanate compound in the base oil (A).

For example, in the case where a compound represented by the general formula (b1) is synthesized, a diisocyanate having a group corresponding to a divalent aromatic hydrocarbon group represented by $R^3$ in the general formula (b1) is used as an isocyanate compound, and an amine having a group corresponding to a monovalent hydrocarbon group represented by $R^1$ and $R^2$ is used as a monoamine, whereby a desired urea-based thickener (B) can be synthesized according to the aforementioned method.

In order to satisfy the requirement (I) and further the requirement (II), from the viewpoint of miniaturizing the urea-based thickener (B) in the grease composition, it is preferred to produce the grease composition containing the component (A) and the component (B) by using a grease manufacturing apparatus as expressed in the following [1].

[1] A grease manufacturing apparatus including a container body having an introduction portion into which a grease raw material is introduced and a discharge portion for discharging the grease into the outside; and a rotor having a rotation axis in an axial direction of an inner periphery of the container body and rotatably provided in the inside of the container body, the rotor including a first concave-convex portion in which (i) concave and convex are alternately provided along a surface of the rotor, the concave and convex being inclined to the rotation axis, and (ii) a feeding ability from the introduction portion to a direction of the discharge portion is provided.

While the grease manufacturing apparatus as set forth in the above [1] is hereunder described, the term "preferred" prescribed below is the embodiment from the viewpoint of miniaturizing the urea-based thickener (B) in the grease composition so as to satisfy the requirement (I) and further the requirement (II), unless otherwise specifically indicated.

FIG. 1 is a schematic cross-sectional view of the grease manufacturing apparatus as set forth in the above [1] that can be used in one embodiment of the present invention.

A grease manufacturing apparatus 1 shown in FIG. 1 includes a container body 2 for introducing a grease raw material into the inside thereof; and a rotor 3 having a rotation axis 12 on a central axis line of an inner periphery of the container body 2 and rotating around the rotation axis 12 as a center axis.

The rotor 3 rotates at high speed around the rotation axis 12 as a center axis to apply a high shearing force to a grease raw material inside the container body 2. Thus, the grease containing the urea-based thickener is produced.

As shown in FIG. 1, the container body 2 is preferably partitioned to an introduction portion 4, a retention portion 5, a first inner peripheral surface 6, a second inner peripheral surface 7, and a discharge portion 8 in this order from an upstream side.

As shown in FIG. 1, it is preferred that the container body 2 has an inner peripheral surface forming such a truncated cone shape that an inner diameter thereof gradually increases from the introduction portion 4 toward the discharge portion 8.

The introduction portion 4 serving as one end of the container body 2 is provided with a plurality of solution introducing pipes 4A and 4B for introducing a grease raw material from the outside of the container body 2.

The retention portion 5 is disposed in a downstream portion of the introduction portion 4, and is a space for temporarily retaining the grease raw material introduced from the introduction portion 4. When the grease raw material is retained in the retention portion 5 for a long time, grease adhered to an inner peripheral surface of the retention portion 5 forms a large lump, so that it is preferred to transport the grease raw material to the first inner peripheral surface 6 in the downstream side in a short time as far as possible. More preferably, it is preferred to transport the grease raw material directly to the first inner peripheral surface 6 without passing through the retention portion 5.

The first inner peripheral surface 6 is disposed in a downstream portion adjacent to the retention portion 5, and the second inner peripheral surface 7 is disposed in a downstream portion adjacent to the first inner peripheral surface 6. As mentioned later in detail, it is preferred to provide a first concave-convex portion 9 on the first inner peripheral surface 6 and to provide a second concave-convex portion 10 on the second inner peripheral surface 7, for the purpose of allowing the first inner peripheral surface 6 and the second inner peripheral surface 7 to function as a high shearing portion for imparting a high shearing force to the grease raw material or grease.

The discharge portion 8 serving as the other end of the container body 2 is a part for discharging the grease agitated on the first inner peripheral surface 6 and the second inner peripheral surface 7, and is provided with a discharge port 11 for discharging grease. The discharge port 11 is formed in a direction orthogonal or approximately orthogonal to the rotation axis 12. According to this, the grease is discharged from the discharge port 11 to the direction orthogonal or approximately orthogonal to the rotation axis 12. However, the discharge port 11 does not necessarily have to be made orthogonal to the rotation axis 12, and can be formed in a direction parallel or approximately parallel to the rotation axis 12.

The rotor 3 is rotatably provided on the center axis line of the inner peripheral surface of the container body 2, which has a truncated cone shape, as a rotation axis 12, and rotates counterclockwise when the container body 2 is viewed from the upstream portion to a downstream portion as shown in FIG. 1.

The rotor 3 has an outer peripheral surface that expands in accordance with the enlargement of the inner diameter of the truncated cone of the container body 2, and the outer peripheral surface of the rotor 3 and the inner peripheral surface of the truncated cone of the container body 2 are maintained at a constant interval.

On the outer peripheral surface of the rotor 3, a first concave-convex portion 13 of the rotor in which concave and convex are alternately provided along a surface of the rotor 3 is provided.

The first concave-convex portion 13 of the rotor is inclined to the rotation axis 12 of the rotor 3 in the direction of from the introduction portion 4 to the discharge portion 8, and has a feeding ability in the direction of from the introduction portion 4 to the discharge portion 8. That is, the first concave-convex portion 13 of the rotor is inclined in the direction in which the solution is pushed toward the downstream side when the rotor 3 rotates in the direction shown in FIG. 1.

A step difference between a concave portion 13A and a convex portion 13B of the first concave-convex portion 13 of the rotor is preferably 0.3 to 30, more preferably 0.5 to 15, and still more preferably 2 to 7, when a diameter of the concave portion 13A on the outer peripheral surface of the rotor 3 is 100.

The number of convex portions 13B of the first concave-convex portion 13 of the rotor in the circumferential direction is preferably 2 to 1,000, more preferably 6 to 500, and still more preferably 12 to 200.

A ratio of the width of the convex portion 13B to the width of the concave portion 13A of the first concave-convex portion 13 of the rotor [(width of the convex portion)/(width of the concave portion)] in a cross section orthogonal to the rotation axis 12 of the rotor 3 is preferably 0.01 to 100, more preferably 0.1 to 10, and still more preferably 0.5 to 2.

An inclination angle of the first concave-convex portion 13 of the rotor with respect to the rotation axis 12 is preferably 2 to 85°, more preferably 3 to 45°, and still more preferably 5 to 20°.

It is preferred that the first inner peripheral surface 6 of the container body 2 is provided with the first concave-convex portion 9 formed with a plurality of concave and convex along the inner peripheral surface thereof.

It is preferred that the concave and convex of the first concave-convex portion 9 on the side of the container body 2 are inclined in the opposite direction to the first concave-convex portion 13 of the rotor.

That is, it is preferred that the plurality of concave and convex of the first concave-convex portion 9 on the side of the container body 2 be inclined in the direction in which the solution is pushed toward the downstream side when the rotation axis 12 of the rotor 3 rotates in the direction shown in FIG. 1. The stirring ability and the discharge ability are further enhanced by the first concave-convex portion 9 having the plurality of concave and convex provided on the first inner peripheral surface 6 of the container body 2.

A depth of the concave and convex of the first concave-convex portion 9 on the side of the container body 2 is preferably 0.2 to 30, more preferably 0.5 to 15, and still more preferably 1 to 5, when the inner diameter (diameter) of the container is set to 100.

The number of concave and convex of the first concave-convex portion 9 on the side of the container body 2 is preferably 2 to 1,000, more preferably 6 to 500, and still more preferably 12 to 200.

A ratio of the width of the concave portion to the width of the convex portion between grooves in the concave and convex of the first concave-convex portion 9 on the side of the container body 2 [(width of the concave portion)/(width of the convex portion)] is preferably 0.01 to 100, more preferably 0.1 to 10, and still more preferably 0.5 to 2 or less.

An inclination angle of the concave and convex of the first concave-convex portion 9 on the side of the container body 2 to the rotation axis 12 is preferably 2 to 85°, more preferably 3 to 45°, and still more preferably 5 to 20°.

By providing the first concave-convex portion 9 on the first inner peripheral surface 6 of the container body 2, the first inner peripheral surface 6 can be made to function as a shearing portion for imparting a high shearing force to the grease raw material or grease, but the first concave-convex portion 9 does not necessarily have to be provided.

It is preferred that a second concave-convex portion 14 of a rotor having concave and convex alternately provided along the surface of the rotor 3 is provided on an outer peripheral surface of a downstream portion of the first concave-convex portion 13 of the rotor.

The second concave-convex portion 14 of the rotor is inclined to the rotation axis 12 of the rotor 3, and has a feeding suppression ability to push the solution back toward the upstream side from the introduction portion 4 toward the discharge portion 8.

A step difference of the second concave-convex portion 14 of the rotor is preferably 0.3 to 30, more preferably 0.5 to 15, and still more preferably 2 to 7, when a diameter of the concave portion of the outer peripheral surface of the rotor 3 is set to 100.

The number of convex portions of the second concave-convex portion 14 of the rotor in the circumferential direction is preferably 2 to 1,000, more preferably 6 to 500, and still more preferably 12 to 200.

A ratio of the width of the convex portion to the width of the concave portion of the second concave-convex portion 14 of the rotor in the cross section orthogonal to the rotation axis of the rotor 3 [(width of the convex portion)/(width of the concave portion)] is preferably 0.01 to 100, more preferably 0.1 to 10, and still more preferably 0.5 to 2.

An inclination angle of the second concave-convex portion 14 of the rotor to the rotation axis 12 is preferably 2 to 85°, more preferably 3 to 45°, and still more preferably 5 to 20°.

It is preferred that the second inner peripheral surface 7 of the container body 2 is provided with the second concave-convex portion 10 formed with a plurality of concave and convex adjacent to a downstream portion of the concave and convex in the first concave-convex portion 9 on the side of the container body 2.

It is preferred that the plurality of concave and convex are formed on the inner peripheral surface of the container body 2, and that the concave and convex are inclined in opposite directions to the inclination direction of the second concave-convex portion 14 of the rotor.

That is, it is preferred that the plurality of concave and convex of the second concave-convex portion 10 on the side of the container body 2 are inclined in the direction in which the solution is pushed back toward the upstream side when the rotation axis 12 of the rotor 3 rotates in the direction shown in FIG. 1. A stirring ability is more enhanced by the concave and convex of the second concave-convex portion 10 provided on the second inner peripheral surface 7 of the container body 2. In addition, the second inner peripheral surface 7 of the container body can function as a shearing portion which imparts a high shearing force to the grease raw material or grease.

A depth of the concave portion of the second concave-convex portion 10 on the side of the container body 2 is preferably 0.2 to 30, more preferably 0.5 to 15, and still more preferably 1 to 5, when the inner diameter (diameter) of the container body 2 is set to 100.

The number of concave portions of the second concave-convex portion 10 on the side of the container body 2 is preferably 2 to 1,000, more preferably 6 to 500, and still more preferably 12 to 200.

A ratio of the width of the convex portion to the width of the concave portion of the concave and convex of the second concave-convex portion 10 on the side of the container body 2 in the cross section orthogonal to the rotation axis 12 of the rotor 3 [(width of the convex portion)/(width of the concave portion)] is preferably 0.01 to 100, more preferably 0.1 to 10, and still more preferably 0.5 to 2 or less.

An inclination angle of the second concave-convex portion 10 on the side of the container body 2 to the rotation axis 12 is preferably 2 to 85°, more preferably 3 to 45°, and still more preferably 5 to 20°.

A ratio of the length of the first concave-convex portion 9 on the side of the container body 2 to the length of the second concave-convex portion 10 on the side of the container body 2 [(length of the first concave-convex portion)/(length of the second concave-convex portion)] is preferably 2/1 to 20/1.

Figure 2:
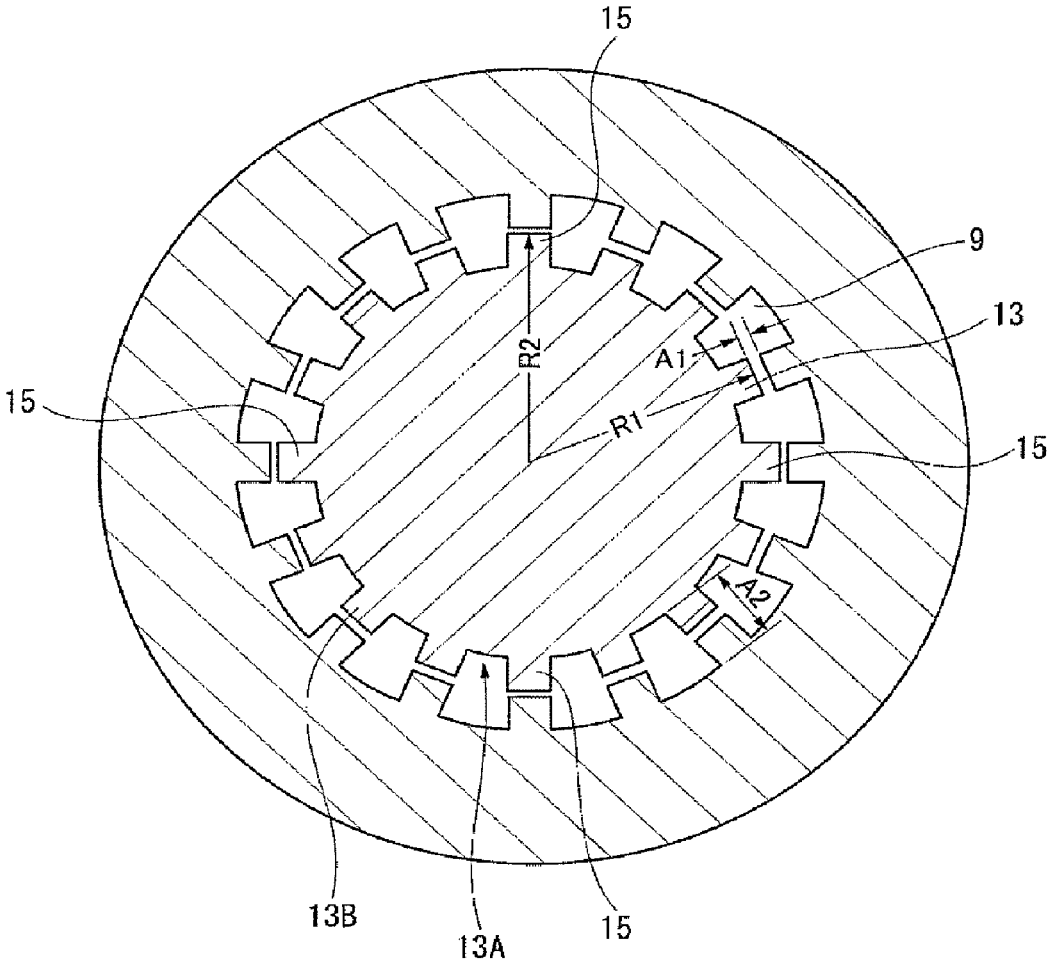
FIG. 2 is a schematic cross-sectional view of the direction orthogonal to a rotation axis in a first concave-convex portion on the side of a container body of the grease manufacturing apparatus of FIG. 1.

FIG. 2 is a cross-sectional view of the direction orthogonal to the rotation axis 12 in the first concave-convex portion 9 on the side of the container body 2 of the grease manufacturing apparatus 1.

In the first concave-convex portion 13 of the rotor shown in FIG. 2, a plurality of scrapers 15 each having a tip protruding toward the inner peripheral surface side of the container body 2 beyond a tip in the projecting direction of the convex portion 13B of the first concave-convex portion 13 are provided. In addition, though not shown, the second concave-convex portion 14 is also provided with a plurality of scrapers in which a tip of the convex portion protrudes toward the inner peripheral surface side of the container body 2, similarly to the first concave-convex portion 13.

The scraper 15 scrapes off the grease adhered to the inner peripheral surface of the first concave-convex portion 9 on the side of the container body 2 and the second concave-convex portion 10 on the side of the container body 2.

With respect to protrusion amount of the tip of the scraper 15 relative to protrusion amount of the convex portion 13B of the first concave-convex portion 13 of the rotor, a ratio [R2/R1] of the radius (R2) of the tip of the scraper 15 to the radius (R1) of the tip of the convex portion 13B is preferably more than 1.005 and less than 2.0.

The number of scrapers 15 is preferably 2 to 500, more preferably 2 to 50, and still more preferably 2 to 10.

In the grease manufacturing apparatus 1 shown in FIG. 2, the scraper 15 is provided, but cannot be provided, or can be provided intermittently.

In order to produce the grease containing the urea-based thickener (B) by the grease manufacturing apparatus 1, the solution α and the solution β which are the aforementioned grease raw materials are introduced respectively from the solution introducing pipes 4A and 4B of the introduction portion 4 of the container body 2, and the rotor 3 is rotated at a high speed, whereby the grease base material containing the urea-based thickener (B) can be produced.

Then, even by blending the sulfur-phosphorus based extreme pressure agent (C), and the other additive (D) with the thus obtained grease base material, the urea-based thickener (B) in the grease composition can be miniaturized so as to satisfy the requirement (I) and further the requirement (II).

As a high-speed rotation condition of the rotor 3, a shear rate applied to the grease raw material is preferably $10^2$ $s^{-1}$ or more, more preferably $10^3$ $s^{-1}$ or more, and still more preferably $10^4$ $s^{-1}$ or more, and it is typically $10^7$ $s^{-1}$ or less.

A ratio of a maximum shear rate (Max) to a minimum shear rate (Min) in the shearing at the time of high-speed rotation of the rotor 3 (Max/Min) is preferably 100 or less, more preferably 50 or less, and still more preferably 10 or less.

In view of the fact that the shear rate relative to the blended solution is as uniform as possible, the urea-based thickener or a precursor thereof in the grease composition is readily miniaturized, whereby a more uniform grease structure is provided.

Here, the maximum shear rate (Max) is a highest shear rate applied to the blended solution, and the minimum shear rate (Min) is a lowest shear rate applied to the blended solution, which are defined as follows.

Maximum shear rate (Max)=(linear velocity at the tip of the convex portion 13*B* of the first concave-convex portion 13 of the rotor)/(gap *A*1 between the tip of the convex portion 13*B* of the first concave-convex portion 13 of the rotor and the convex portion of the first concave-convex portion 9 of the first inner peripheral surface 6 of the container body 2)

Minimum shear rate (Min)=(linear velocity of the concave portion 13*A* of the first concave-convex portion 13 of the rotor)/(gap *A*2 between the concave portion 13*A* of the first concave-convex portion 13 of the rotor and the concave portion of the first concave-convex portion 9 on the first inner peripheral surface 6 of the container body 2)

The gap A1 and the gap A2 are as shown in FIG. 2.

The grease manufacturing apparatus 1 is provided with the scraper 15, thereby grease adhered to the inner peripheral surface of the container body 2 can be scraped off, so that the generation of the lumps during kneading can be prevented, and the grease in which the urea-based thickener (B) is miniaturized can be continuously produced in a short time.

In view of the fact that the scraper 15 scrapes off the grease adhered thereto, it is possible to prevent the retained grease from becoming a resistance to rotation of the rotor 3, so that the rotational torque of the rotor 3 can be reduced, and the power consumption of the chive source can be reduced, thereby making it possible to continuously produce the grease efficiently.

Since the inner peripheral surface of the container body 2 is in a shape of a truncated cone whose inner diameter increases from the introduction portion 4 toward the discharge portion 8, the centrifugal force has an effect for discharging the grease or grease raw material in the downstream direction, and the rotation torque of the rotor 3 can be reduced to continuously produce the grease.

Since the first concave-convex portion 13 of the rotor is provided on the outer peripheral surface of the rotor 3, the first concave-convex portion 13 of the rotor is inclined to the rotation axis 12 of the rotor 3, the first concave-convex portion 13 has a feeding ability from the introduction portion 4 to the discharge portion 8, the second concave-convex portion 14 of the rotor is inclined to the rotation axis 12 of the rotor 3, and the second concave-convex portion 14 has a feeding suppression ability from the introduction portion 4 to the discharge portion 8, a high shear force can be given to the solution, and the urea-based thickener (B) in the grease composition can be miniaturized so as to satisfy the requirement (I) and further the requirement (II) even after blending the additive.

Since the first concave-convex portion 9 is formed on the first inner peripheral surface 6 of the container body 2 and is inclined in the opposite direction to the first concave-convex portion 13 of the rotor, in addition to the effect of the first concave-convex portion 13 of the rotor, sufficient stirring of grease raw material can be carried out while extruding the grease or grease raw material in the downstream direction, and the urea-based thickener (B) in the grease composition can be miniaturized so as to satisfy the requirement (I) and further the requirement (II) even after blending the additive.

The second concave-convex portion 10 is provided on the second inner peripheral surface 7 of the container body 2, and the second concave-convex portion 14 of the rotor is provided on the outer peripheral surface of the rotor 3, thereby the grease raw material can be prevented from flowing out from the first inner peripheral surface 6 of the container body more than necessary, so that the urea-based thickener (B) can be miniaturized so as to satisfy the requirement (I) and further the requirement (II) even after blending the additive by giving a high shear force to the solution to highly disperse the grease raw material.

<Sarcosine Derivative (C)>

The grease composition of the present invention contains a sarcosine derivative (C) together with the component (A) and the component (B).

By incorporating the sarcosine derivative (C) in the grease composition of the present invention, the lubricating performance of a ball joint constituted by the metal material and a resin material, etc. is improved, and thus stick slip can be suppressed.

The sarcosine derivative (C) can be an α-amino acid in which an amino group having a methyl group is bonded to the carbon atom to which a carboxy group is bonded, and can be N-methylglycine or a fatty amino acid having an N-methylglycine backbone.

Examples of the sarcosine derivative (C) include N-oleoylsarcosine, N-stearoylsarcosine, N-lauroylsarcosine, N-myristoylsarcosine and N-palmitoylsarcosine.

These sarcosine derivatives (C) can be used alone or in combination of two or more kinds.

The sarcosine derivative (C) is preferably a compound represented by the following formula (c-1).

[Chem. 1]

(c-1)

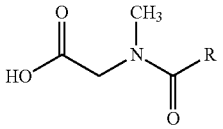

In the formula (c-1), R is an alkyl group having 1 to 30 carbon atoms, or an alkenyl group having 1 to 30 carbon atoms.

The alkyl group and alkenyl group for R in the formula (c-1) have 1 to 30 carbon atoms, and preferably 6 to 27, more preferably 10 to 24, still more preferably 12 to 20 carbon atoms. The alkyl group can be a linear alkyl group, or can be a branched chain alkyl group. Furthermore, the alkenyl group can also be a linear alkenyl group, or can be a branched chain alkenyl group.

As the sarcosine derivative (C), N-oleoylsarcosine is preferable.

In the grease composition of one embodiment of the present invention, the content of the nitrogen atom derived from the sarcosine derivative (C) is preferably 1 mass % to 10 mass %, more preferably 1.5 mass % to 8 mass %, still more preferably 2 mass % to 5 mass % on the basis of the total amount (100% by mass) of the grease composition, from the viewpoint of further improving the effect to suppress stick slip.

In the grease composition of the present invention, the content of the sarcosine derivative (C) is preferably 0.1 to 10.0 mass %, more preferably 1.0 to 8.0 mass %, still more preferably 1.5 to 6.0 mass % on the basis of the total amount (100% by mass) of the grease composition, from the viewpoint of suppressing stick slip.

<Fatty Acid Zinc Salt (D)>

The grease composition of the present invention contains a fatty acid zinc salt (D) together with the component (A), the component (B) and the component (C).

Furthermore, the content of the fatty acid zinc salt (D) in the grease composition of the present invention is 10 mass % to 20 mass % based on a total amount of the grease composition.

By incorporating the fatty acid zinc salt (D) by 10 mass % to 20 mass % based on a total amount of the grease composition in the grease composition of the present invention, the lubricating performance of a ball joint constituted by the metal material and a resin material, etc. is improved, and thus stick slip can be suppressed.

The fatty acid for constituting the fatty acid zinc salt (D) can be a monobasic acid or a polybasic acid. Furthermore, fatty acid for constituting the the fatty acid zinc salt (D) can be a saturated fatty acid, or can be an unsaturated fatty acid. Furthermore, the fatty acid for constituting the fatty acid zinc salt (D) can be linear, or can have branched chains.

The carbon number of the fatty acid for constituting the fatty acid zinc salt (D) is preferably 8 to 30, more preferably 12 to 24, still more preferably 15 to 20.

Examples of the monobasic acid (saturated fatty acid) include octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, henicosanoic acid, docosanoic acid, tricosanoic acid, tetracosanoic acid, pentacosanoic acid, hexacosanoic acid, heptacosanoic acid, octacosanoic acid, nonacosanoic acid and triacontanoic acid.

Examples of the monobasic acid (unsaturated fatty acid) include octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, eicosenoic acid, heneicosenoic acid, docosenoic acid, tricosenoic acid, tetracosenoic acid, pentacosenoic acid, hexacosenoic acid, heptacosenoic acid, octacosenoic acid, nonacosenoic acid, triacontenoic acid, etc.

Examples of the polybasic acid (saturated fatty acid) include octane diacid, nonane diacid, decane diacid, undecane diacid, dodecane diacid, tridecane diacid, tetradecane diacid, pentadecane diacid, hexadecane diacid, heptadecane diacid, octadecane diacid, nonadecane diacid, eicosanoic diacid, heneicosanoic diacid, docosanoic diacid, tricosanoic diacid, tetracosanoic diacid, pentacosanoic diacid, hexacosanoic diacid, heptacosanoic diacid, octacosanoic diacid, nonacosanoic diacid and triacontanoic diacid.

Examples of the polybasic acid (unsaturated fatty acid) include octene diacid, nonene diacid, decene diacid, undecene diacid, dodecene diacid, tridecene diacid, tetradecene diacid, pentadecene diacid, hexadecene diacid, heptadecene diacid, octadecene diacid, nonadecene diacid, eicosene diacid, henicosene diacid, docosene diacid, tricosene diacid, tetracosene diacid, pentacosene diacid, hexacosene diacid, heptacosene diacid, octacosene diacid, nonacosene diacid and triacontenic diacid.

Among these, octadecanoic acid (stearic acid) is preferable.

In the grease composition of one embodiment of the present invention, the content of the zinc atom derived from the fatty acid zinc salt (D) is preferably 0.1 mass % to 3.0 mass %, more preferably 0.5 mass % to 2.5 mass %, still more preferably 1.0 mass % to 2.0 mass % on the basis of the total amount (100% by mass) of the grease composition, from the viewpoint of further improving the effect to suppress stick slip.

In the grease composition of the present invention, the content of the fatty acid zinc salt (D) is 10 mass % to 20 mass %, preferably 11 mass % to 18 mass %, more preferably 13 mass % to 17 mass % on the basis of the total amount (100% by mass) of the grease composition.

The content ratio [(B)/(D)] of the urea-based thickener (B) to the fatty acid zinc salt (D) is preferably 0.1 to LO, more preferably 0.1 to 0.8, still more preferably 0.1 to 0.6, yet still more preferably 0.15 to 0.6, further still preferably 0.2 to 0.5 by mass ratio, from the viewpoint of balancing between a low temperature property and an effect to suppress stick slip.

The content ratio [(C)/(D)] of the sarcosine derivative (C) to the fatty acid zinc salt (D) is preferably 0.03 to 0.4, more preferably 0.03 to 0.3, still more preferably 0.05 to 0.3, yet still more preferably 0.1 to 0.3, even yet still more preferably 0.15 to 0.25 by mass ratio, from the viewpoint of suppressing stick slip.

<Additive (E)>

The grease composition of one embodiment of the present invention can contain an additive (E) other than the component (B), the component (C) and the component (D), which is contained in general greases, within a range where the effects of the present invention are not impaired.

Examples of the additive (E) include an oily agent, an antioxidant, a synthetic wax, a thickener, a rust inhibitor, a dispersant, a metal deactivator and an extreme pressure agent.

Each additive (E) can be used by one kind alone, or can be used in combination of two or more kinds.

Examples of the oily agent can include a fatty alcohol; a fatty acid and a fatty acid compound such as a fatty acid metal salt; an ester compound such as a fatty acid ester, a polyol ester, a sorbitan ester and a glyceride; an amine compound such as a fatty amine; and an amide compounds.

Examples of the antioxidant include an amine-based antioxidant such as a diphenylamine-based compound and a naphthylamine-based compound, and a phenol-based antioxidant such as a monocyclic phenol-based compound and a polycyclic phenol-based compound.

Examples of the synthetic wax include a polyethylene wax, a polypropylene wax, a copolymer wax such as an ethylene-propylene-hexene-vinyl acetate, an acrylic acid, a Fischer-Tropsch wax, a hydrocarbon wax such as a polymethylene wax, and a synthetic amide wax.

In the case where the grease composition of one embodiment of the present invention contains a synthetic wax, the content of the synthetic wax is preferably 0.2 mass % to 2.0 mass %, more preferably 0.5 mass % to 1.5 mass %, still more preferably 0.8 mass % to 1.2 mass % on the basis of the total amount (100% by mass) of the grease composition, in view of improvement of the low temperature property.

Examples of the thickener include a polymethacrylate (PMA), an olefin copolymer (OCP), a polyalkylstyrene (PAS) and a styrene-diene copolymer (SCP).

Examples of the rust inhibitor include a carboxylic acid-based rust inhibitor such as an alkenylsuccinic acid polyvalent alcohol ester, a thiadiazole and a derivative thereof, and a benzotriazole and a derivative thereof.

Examples of the dispersant include ashless dispersants such as imide succinate and boron-based succinimides.

Examples of the metal deactivator include a benzotriazole-based compound.

Examples of the extreme pressure agent include a zinc dialkyldithiophosphate, a molybdenum dialkyldithiophosphate, a thiocarbamate such as an ashless-based dithiocarbamate, zinc dithiocarbamate and molybdenum dithiocarbamate; a sulfur compound such as a sulfurized fat and oil, an olefin sulfide, a polysulfide, a thiophosphate, a thioterpene and a dialkylthiodipyropionate; a phosphate ester such as tricresyl phosphate; and a phosphite ester such as triphenyl phosphite.

In the grease composition of one embodiment of the present invention, the content of the additive (E) is each independently generally 0.01 to 20 mass %, preferably 0.01 to 15 mass %, more preferably 0.01 to 10 mass %, still more preferably 0.01 to 7 mass % on the basis of the total amount (100% by mass) of the grease composition.

<Zinc-Containing Compound Other than Fatty Acid Zinc Salt (D)>

In the grease composition of one embodiment of the present invention, it is preferable to decrease the content of the zinc-containing compound other than the fatty acid zinc salt (D) from the viewpoint of making the effect of the present invention exert more easily.

The content of the zinc-containing compound other than the fatty acid zinc salt (D) is preferably lower than 1.0 mass %, more preferably lower than 0.1 mass %, still more preferably lower than 0.01 mass %, and the most preferably free from the zinc-containing compound other than the fatty acid zinc salt (D), on the basis of the total amount (100% by mass) of the grease composition.

<Physical Property of Grease Composition>

(Worked Penetration)

The worked penetration at 25° C. of the grease composition of one embodiment of the present invention is preferably 240 to 450, more preferably 260 to 450, still more preferably 265 to 340 from the viewpoint of improving the low temperature property.

Incidentally, in the present specification, the worked penetration of the grease composition means a value measured at 25° C. in conformity with JIS K2220:2013.

(Dropping Point)

The dropping point of the grease composition of one embodiment of the present invention is preferably 100 to 300, more preferably 120 to 280, still more preferably 150 to 270, yet still more preferably 180 to 260, and even yet still more preferably 190 to 250.

In this specification, the worked penetration of the grease composition means a value measured at 25° C. in accordance with JIS K2220:2013.

(Content of Zinc Atom in Grease Composition)

The content of the zinc atom in the grease composition of one embodiment of the present invention is preferably 0.1 mass % to 3.0 mass %, more preferably 0.5 mass % to 2.5 mass %, still more preferably 1.0 mass % to 2.0 mass % on the basis of the total amount (100% by mass) of the grease composition, from the viewpoint of making the effect of the present invention exert more easily.

The content of the zinc atom can be measured in conformity with JPI-5S-38-03.

(Low Temperature Torque)

The starting torque at a low temperature of the grease composition of one embodiment of the present invention is preferably 600 or less, more preferably 580 or less.

The rotating torque at a low temperature of the grease composition of one embodiment of the present invention is preferably 460 or less, more preferably 450 or less.

Incidentally, in the present specification, the low temperature torque of the grease composition means a starting torque (unit: N·m) and a rotating torque (unit: N-m) obtained at a temperature: −40° C. in conformity with JIS K2220: 2013.

Incidentally, the starting torque is a torque that is necessary for outputting a power from a static state, and a smaller starting torque is more preferable. Furthermore, the rotating torque is a torque that is necessary for outputting a power continuously, and a smaller rotating torque is more preferable.

(Suppression of Stick Slip)

Regarding the grease composition of one embodiment of the present invention, in a Lissajous waveform, which is obtained by the method described in Examples mentioned below, a smaller degree of stick slip is more preferable, and connecting smoothly is still more preferable, in the vicinity of an angle around the X axis of −10°.

<Method for Producing Grease Composition>

The grease composition of the present invention can be produced by blending the base oil (A), a grease containing the urea-based thickener (B) (base grease), the sarcosine derivative (C), the fatty acid zinc salt (D), and the additive (E) as necessary.

For example, the grease composition can be produced by blending the base oil (A) and the fatty acid zinc salt (D), adding the sarcosine derivative (C), the additive (E), and then blending with the grease containing the urea-based thickener (B) (base grease).

<Use of Grease Composition>

The grease composition of the present invention has an excellent low temperature property, and can further suppress stick slip. Specifically, when used in lubrication of a sliding part constituted by a metal material and a resin material, the grease composition has an excellent low temperature property, and further has an excellent effect to suppress stick slip.

Therefore, the grease composition of one embodiment of the present invention can preferably be used for use in lubrication of sliding parts of various apparatuses, and is especially preferably used for use in lubrication of apparatuses having a sliding part constituted by a metal material and a resin material.

The metal material is preferably various alloys such as stainless alloys and aluminum alloys, and copper. Incidentally, the metal material can be replaced with a material having a high strength (for example, a ceramic material).

Examples of the resin material can be a natural resin or can be a synthetic resin, and a general-purpose plastic (polyethylene, polystyrene, polypropylene, polyvinyl chloride, etc.) and an engineering plastic of a synthetic resin are preferable, and an engineer plastic is more preferable in view of heat-resistance and mechanical strength.

Examples of the engineering plastic include a synthetic resin such as a polyamide resin, a polyacetal resin, a polycarbonate resin, a polysulfone resin, a polyphenylene sulfide resin, a polyamideimide resin, a polyether ether ketone resin, a phenolic resin, a polyester resin and an epoxy resin.

Examples of the field of the apparatus for which the grease composition of the present invention can be suitably used include the automobile field, the office equipment field, the machine-tool field, the windmill field, the field for construction, the field for agricultural machine, and the industrial robot field.

Examples of the portion to be lubricated in the apparatus for the automobile field, in which the grease composition of the present invention can be suitably used, include a bearing portion in an apparatus, such as a radiator fan motor, a fan coupling, an alternator, an idler pulley, a hub unit, a water pump, a power window, a wiper, an electric power steering, a driving electric motor fly wheel, a ball joint, a wheel bearing, a spline portion, and a constant velocity joint; and a bearing portion, a gear portion, or a sliding portion in an apparatus, such as a door lock, a door hinge, and a clutch booster.

More specifically, examples include a bearing portion in a hub unit, an electric power steering, a driving electric motor fly wheel, a ball joint, a wheel bearing, a spline portion, a constant velocity joint, a clutch booster, a servomotor, a blade bearing or a power generator.

Examples of the portion to be lubricated in the apparatus for the field of business equipment, in which the grease composition of the present invention can be suitably used, include a fixing roll in an apparatus, such as a printer, and bearing and gear portions in an apparatus, such as a polygon motor.

Examples of the portion to be lubricated in the apparatus for the field of machine tools, in which the grease composition of the present invention can be suitably used, include bearing portions in a reduction gear, such as a spindle, a servo motor, and a working robot.

Examples of the portion to be lubricated in the apparatus for the field of windmill, in which the grease composition of the present invention can be suitably used, include a blade bearing and bearing portions in a generator.

Examples of the portion to be lubricated in the apparatus for the field of construction or agricultural machinery, in which the grease composition of the present invention can be suitably used, include a bearing portion, a gear portion, and a sliding portion, such as a ball joint and a spline part.

One embodiment of the apparatus to which the grease composition of the present invention can be applied is preferably a ball joint having a ball stud made of a metal, a housing, and a ball sheet made of a resin disposed between the ball stud and the housing. By constituting the apparatus to have the constitution, the apparatus has an excellent low temperature property, and further, the apparatus can suppress stick slip. Therefore, in the case where the apparatus is used in a vehicle, an effect to maintain an excellent ride quality for a long period of time can significant be exerted.

One embodiment of the apparatus to which the grease composition of the present invention can be applied is preferably a ball bearing in which the above-mentioned sliding mechanism has a retainer made of a metal, a roller made of a metal, and a retainer made of a resin. By constituting the apparatus to have the constitution, the apparatus can have an excellent low temperature property, and further, the apparatus can suppress stick slip. Therefore, in the case where the apparatus is used in a vehicle, an effect to maintain an excellent ride quality for a long period of time can significant be exerted.

[Method for Lubricating Sliding Mechanism]

The method for lubricating a sliding mechanism that can be applied to the grease composition of the present invention is a method for lubricating a sliding mechanism in which a metal material and a resin material are slid by the grease composition of the present invention.

According to the method for lubricating a sliding mechanism that can be applied to the grease composition of the present invention, a kinematic friction force at a lubricated part can appropriately be maintained. The effect can provide an excellent low temperature property, and can further suppress stick slip in the case where the sliding mechanism is a ball joint having a ball stud made of a metal, a housing, and a ball sheet made of a resin disposed between the ball stud and the housing. Therefore, when used in a vehicle, the effect to maintain an excellent ride quality for a long period of time can be more significant.

EXAMPLES

The present invention is hereunder specifically described by reference to Examples, but it should be construed that the present invention is not limited to the following Examples.

[Various Physical Properties Values]

The measurement methods of various physical properties values are as follows.

(1) Kinematic Viscosity at 40° C., Kinematic Viscosity at 100° C., and Viscosity Index of Base Oil (A) (Blended Base Oil)

The measurement and calculation were performed in conformity with JIS K2283:2000.

(2) Number Average Molecular Weight (Mn) of Ultra-High Viscosity Hydrocarbon-based Synthetic Oil (A3)

Values measured in terms of standard polystyrene according to the following measurement conditions using a gel permeation chromatograph (manufactured by Agilent, apparatus name: "Type 1260 HPLC") were used.

—Measurement Conditions—

Column: two pieces of "Shodex LF404" are connected sequentially.

Column temperature: 35° C.

Developing solvent: chloroform

Flux: 0.3 mL/min (3) Worked Penetration of Grease Composition

The worked penetration was measured at 25° C. in conformity with JIS K2220:2013.

(4) Dropping Point of Grease Composition

The dropping was measured in conformity with JIS K2220:2013.

(5) Content of Zinc Atom in Grease Composition

The content of zinc atom was measured in conformity with JPI-5S-38-03.

First, the low temperature property is evaluated by Example 1 and Comparative Example 1 shown below.

[Raw Materials]

In Example 1 and Comparative Example 1, the base oil (A), the sarcosine derivative (C), the fatty acid zinc salt (D), and the additive (E) used as the raw materials for preparing the grease composition were as follows.

Incidentally, the base oil (A) used in Example 1 and Comparative Example 1 was prepared by incorporating and blending the base oil (A1), the base oil (A2), and the base oil (A3) mentioned below at the amounts described in Table 1.

<Base Oil (A)>

High viscosity hydrocarbon-based synthetic oil (A1) (a poly-α-olefin having a weight average molecular weight of 1,400, 40° C. kinematic viscosity: 400 $mm^2/s$, 100° C. kinematic viscosity: 40 $mm^2/s$, viscosity index: 149)

Low viscosity hydrocarbon-based synthetic oil (A2) (a poly-α-olefin having a weight average molecular weight of 555, 40° C. kinematic viscosity: 30 $mm^2/s$, 100° C. kinematic viscosity: 6 $mm^2/s$, viscosity index: 132)

Ultra-high viscosity hydrocarbon-based synthetic oil (A3-1) (number average molecular weight (Mn): 3,500 to 4,500, 40° C. kinematic viscosity: 37,500 $mm^2/s$, 100° C. kinematic viscosity: 2,000 $mm^2/s$, viscosity index: 300)

Ultra-high viscosity hydrocarbon-based synthetic oil (A3-2) (product name "Polybutene 200011", manufactured by Idemitsu Kosan Co., Ltd., 100° C. kinematic viscosity: 4,300 $mm^2/s$)

<Sarcosine Derivative (C)>

Sarcosine derivative (C1): N-oleoylsarcosine

<Fatty Acid Zinc Salt (D)>

Fatty acid zinc salt (D1): zinc stearate

<Additive (E)>

An oily agent, an antioxidant, and a thickener at predetermined amounts.

Example 1

(1) Synthesis of Urea Grease

First, a base oil (A) obtained by blending 41.5 parts by mass of the high viscosity hydrocarbon-based synthetic oil (A1), 11.0 parts by mass of the low viscosity hydrocarbon-based synthetic oil (A2), 12.5 parts by mass of the ultra-high viscosity hydrocarbon-based synthetic oil (A3-1), and 6.0 parts by mass of the ultra-high viscosity hydrocarbon-based synthetic oil (A3-2) was taken and divided into three portions of the same amount.

Next, the first base oil (A) taken and divided into one-third was heated to 70° C. 1.97 parts by mass of diphenylmethane-4,4'-diisocyanate was added to the heated base oil (A) to prepare a solution α.

In addition, the second base oil (A) taken and divided into one-third was heated to 70° C., and 2.47 parts by mass of octadecylamine and 0.60 parts by mass of cyclohexylamine were added to prepare a solution β.

Then, using the grease manufacturing apparatus 1 shown in FIG. 1, the solution cc which had been heated at 70° C. was introduced at a flow rate of 150 L/h from the solution introducing pipe 4A into the container body 2, and the solution β which had been heated at 70° C. was simultaneously introduced at a flow rate of 150 L/h from the solution introducing pipe 4B into the container body 2, and the solution α and the solution β were unintermittently continuously introduced into the container body 2 in a state of rotating the rotor 3, thereby synthesizing a urea grease (b1).

The rotation number of the rotator 3 of the grease manufacturing apparatus 1 used was 8,000 rpm. In addition, on this occasion, a maximum shear rate (Max) was 10,500 $s^{-1}$, and stirring was performed by setting a ratio of a maximum shear rate (Max) to a minimum shear rate (Min) [Max/Min] to 3.5.

The urea-based thickener (B1) contained in the urea grease (b1) is corresponding to a compound represented by the general formula (b1) wherein $R^1$ and $R^2$ are selected from a cyclohexyl group and an octadecyl group, and $R^3$ is a diphenylmethylene group.

In addition, a molar ratio of octadecylamine and cyclohexylamine used as the raw materials (octadecylamine/cyclohexylamine) is 60/40.

(2) Preparation of Grease Composition

In the above-mentioned (1), the urea grease (b1) ejected from the grease manufacturing apparatus 1 shown in FIG. 1 was stirred, and cooled by natural cooling.

Next, the third base oil (A) taken and divided into one-third and 15.5 parts by mass of the fatty acid zinc salt (D1) were blended, and the sarcosine derivative (C1), and the additive (E) were added at the contents shown in Table 1. Thereafter the mixture was blended with the urea grease (b1) cooled by natural cooling to give the grease composition of Example 1.

Comparative Example 1

(1) Synthesis of Urea Grease

First, a base oil (A) obtained by blending 41.5 parts by mass of the high viscosity hydrocarbon-based synthetic oil (A1), 11.0 parts by mass of the low viscosity hydrocarbon-based synthetic oil (A2), 12.5 parts by mass of the ultra-high viscosity hydrocarbon-based synthetic oil (A3-1), and 6.0 parts by mass of the ultra-high viscosity hydrocarbon-based synthetic oil (A3-2) was taken and divided into three portions of the same amount.

Next, the first base oil (A) taken and divided into one-third was heated to 70° C. 1.97 parts by mass of diphenylmethane-4,4'-diisocyanate was added to the heated base oil (A) to prepare a solution α.

In addition, the second base oil (A) taken and divided into one-third was heated to 70° C., and 2.47 parts by mass of octadecylamine and 0.60 parts by mass of cyclohexylamine were added to prepare a solution β.

Figure 3:
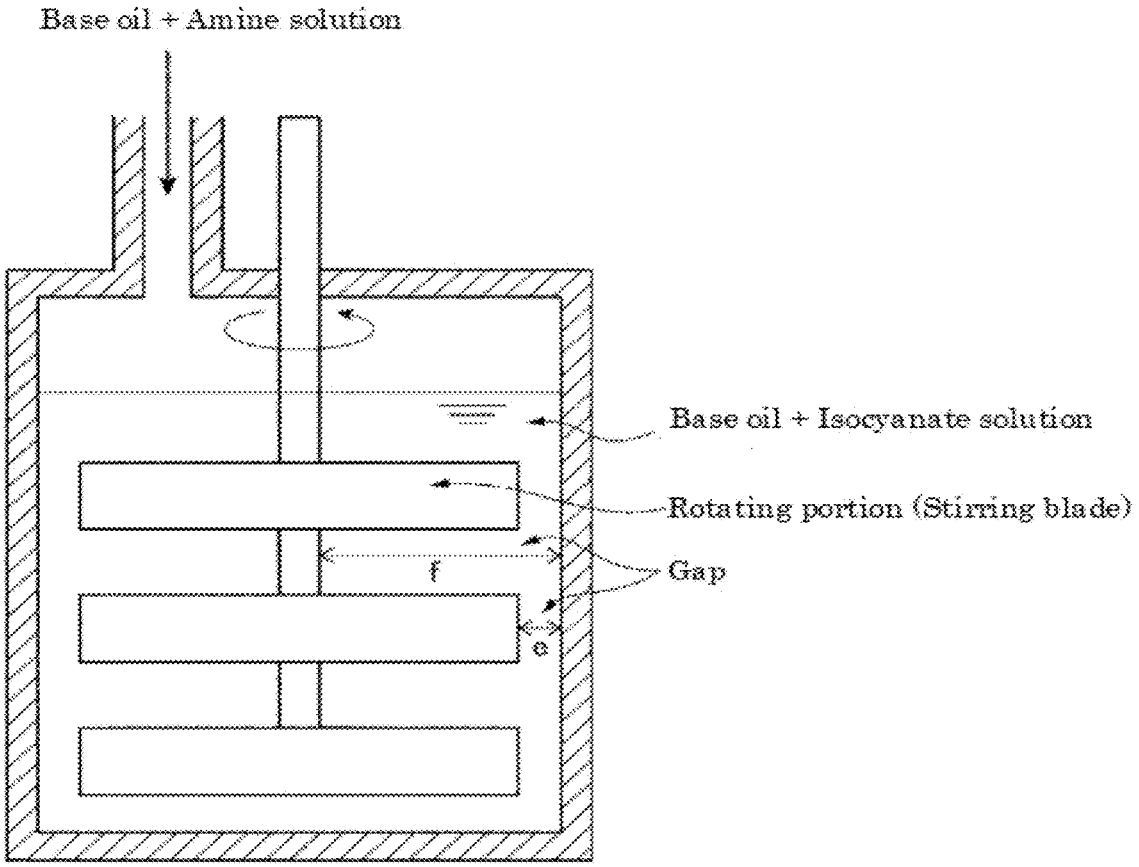
FIG. 3 is a schematic cross-sectional view of a grease manufacturing apparatus used in Comparative Example 1.

Then, using a grease manufacturing apparatus 1 shown in FIG. 3, the solution α which had been heated at 70° C. was introduced at a flow rate of 504 L/h from a solution introducing pipe into a container body. Thereafter, the solution β which had been heated at 70° C. was introduced at a flow rate of 144 L/h from the solution introducing pipe into the container body having the solution a charged therein. After introducing all of the solutions β into the container body, a stirrer was rotated, and the temperature was raised to 160° C. while continuing the stirring, followed by holding for 1 hour to synthesize a urea grease (b2).

On this occasion, a maximum shear rate (Max) was 42,000 $s^{-1}$, and stirring was performed by setting a ratio of a maximum shear rate (Max) to a minimum shear rate (Min) [Max/Min] to 1.03.

The urea-based thickener (B2) contained in the urea grease (b2) is corresponding to a compound represented by the general formula (b1) wherein $R^1$ and $R^2$ are selected from a cyclohexyl group and an octadecyl group, and $R^3$ is a diphenylmethylene group.

In addition, a molar ratio of octadecylamine and cyclohexylamine used as the raw materials (octadecylamine/cyclohexylamine) is 60/40.

(2) Preparation of Grease Composition

Next, the third base oil (A) taken and divided into one-third and 15.5 parts by mass of the fatty acid zinc salt (D1) were blended, and the sarcosine derivative (C1), and the additive (E) were added at the contents shown in Table 1. Thereafter the mixture was blended with the urea grease (b2) to give the grease composition of Comparative Example 1.

[Requirements]

For the urea greases synthesized in Example 1 and Comparative Example 1, the following calculations were carried out.

(1) Calculation of Particle Diameter of Particles Containing Urea-Based Thickener: Requirement (I)

The particle diameter of the particles containing the urea-based thickener in the grease composition was evaluated. Specifically, each of the urea greases as synthesized in Example 1 and Comparative Example 1 was used as a measurement sample and calculated for the particle diameter of the particles containing the urea-based thickener (B) by the following procedures.

First, the measurement sample was defoamed in vacuum and then filled in a 1-mL syringe; 0.10 to 0.15 mL of the sample was extruded from the syringe; and the extruded sample was placed on a surface of a platy cell of a fixture for paste cell. Then, another platy cell was superimposed on the sample, thereby obtaining a measuring cell having the sample sandwiched by two sheets of the cells. Then, using a laser diffraction type particle diameter analyzer (a trade name: LA-920 (manufactured by Horiba, Ltd.)), an arithmetic average particle diameter on an area basis of the particles in the sample of the measuring cell was measured.

Here, the "arithmetic average particle diameter on an area basis" means a value obtained by arithmetically averaging the particle diameter distribution on an area basis. The particle diameter distribution on an area basis is one expressing a frequency distribution of the particle diameter in the whole of particles as an object for measurement on the basis of an area calculated from the particle diameter (in detail, a cross-sectional area of particles having the foregoing particle diameter). In addition, the value obtained by arithmetically averaging the particle diameter distribution on an area basis can be calculated according to the following equation (1).

$$\text{Arithmetic average particle diameter} = \Sigma\{q(J)\times X(J)\}\div\Sigma\{q(J)\} \quad (1)$$

In the equation (1), J means a division number of particle diameter; q(J) means a frequency distribution value (unit: %); and X(J) means a representative diameter (unit: μm) in a range of the J-th particle diameter.

(2) Calculation of Specific Surface Area of Particles Containing Urea-Based Thickener: Requirement (II)

The specific surface area was calculated using the particle diameter distribution of the particles containing the urea-based thickener in the grease composition as measured in the aforementioned section of <Evaluation of Particle Diameter: Requirement (I)>. Specifically, using the foregoing particle diameter distribution, the total of surface areas (unit: $cm^2$) of particles per unit volume (1 $cm^3$) was calculated, and this was designated as the specific surface area (unit: $cm^2/cm^3$).

[Evaluation of Low Temperature Property]—Low Temperature Torque—

For the grease compositions of Example 1 and Comparative Example 1, the following evaluations were carried out.

Using the grease composition prepared in conformity with JIS K2220:2013, the starting torque (unit: N·m) and rotating torque (unit: N·m) at a low temperature (−40° C.) were obtained.

Incidentally, the starting torque is a torque necessary for outputting a power from a static state, and a smaller starting torque is more preferable. Furthermore, the rotating torque is a torque necessary for continuing outputting a power continuously, and a smaller rotating torque is more preferable.

The evaluation results are shown in Table 1.

TABLE 1

| Constitutional components (unit) | | | | Example 1 | Comparative Example 1 |
|---|---|---|---|---|---|
| Grease composition | Base oil (A) | High viscosity hydrocarbon-based synthetic oil (A1) | mass % | 41.5 | 41.5 |
| | | Low viscosity hydrocarbon-based synthetic oil (A2) | mass % | 11.0 | 11.0 |
| | | Ultra-high viscosity hydrocarbon-based synthetic oil (A3-1) | mass % | 12.5 | 12.5 |
| | | Ultra-high viscosity hydrocarbon-based synthetic oil (A3-2) | mass % | 6.0 | 6.0 |
| | Urea-based thickener (B) | Urea-based thickener (B1) | mass % | 5.0 | — |
| | | Urea-based thickener (B2) | mass % | — | 5.0 |
| | Sarcosine derivative (C) | Sarcosine derivative (C1) | mass % | 3.0 | 3.0 |
| | Fatty acid zinc salt (D) | Fatty acid zinc salt (D1) | mass % | 15.5 | 15.5 |
| | Additive (E) | Additive (E) | mass % | 5.5 | 5.5 |
| | | Total | mass % | 100.0 | 100.0 |

TABLE 1-continued

| Constitutional components (unit) | | | | Example 1 | Comparative Example 1 |
|---|---|---|---|---|---|
| Physical property values | Base oil (A) (Blended base oil) | 40° C. kinematic viscosity | $mm^2/s$ | 1074 | 1074 |
| | | 100° C. kinematic viscosity | $mm^2/s$ | 97 | 97 |
| | | Viscosity index | — | 180 | 180 |
| | Urea-based thickener (B) | Arithmetic average particle diameter of particles | μm | 0.33 | 132 |
| | | Specific surface area of particles | $cm^2/cm^3$ | $1.8 \times 10^5$ | $7.1 \times 10^4$ |
| | Grease composition | Worked penetration | — | 317 | 325 |
| | | Dropping point | ° C. | 210 | 212 |
| Content of zinc atom derived from fatty acid zinc salt (D1) in grease composition | | | mass % | 1.7 | 1.7 |
| Evaluation result | Low temperature torque (−40° C.) | Starting torque | mN · m | 570 | 620 |
| | | Rotating torque | mN · m | 430 | 470 |

The results of Table 1 reveal as follows.

From Comparative Example 1, it is noted that since the particle diameter of the particles containing the urea-based thickener did not satisfy the requirement (I), the starting torque and the rotating torque were high in the evaluation of the low temperature torque at −40° C., and thus the low temperature property was not able to be ensured.

On the other hand, it is noted that both the starting torque and the rotating torque were smaller in Example 1 than those of Comparative Example 1, and thus Example 1 had an excellent low temperature property.

Next, suppression of stick slip is evaluated by the above-mentioned Example 1, Comparative Example 1, and Comparative Example 2 shown below.

Comparative Example 2

(1) Synthesis of Urea Grease

Abase oil (A) obtained by blending 17.0 parts by mass of the high viscosity hydrocarbon-based synthetic oil (A1), 10.5 parts by mass of the low viscosity hydrocarbon-based synthetic oil (A2), 7.5 parts by mass of the ultra-high viscosity hydrocarbon-based synthetic oil (A3-1), and 5.0 parts by mass of the ultra-high viscosity hydrocarbon-based synthetic oil (A3-2) was heated to 70° C. To the heated base oil (A) was added 3.75 parts by mass of diphenylmethane-4,4'-diisocyanate to prepare a solution α.

Furthermore, 17.0 parts by mass of the high viscosity hydrocarbon-based synthetic oil (A1), 10.5 parts by mass of the low viscosity hydrocarbon-based synthetic oil (A2), 7.5 parts by mass of the ultra-high viscosity hydrocarbon-based synthetic oil (A3-1), and 5.0 parts by mass of the ultra-high viscosity hydrocarbon-based synthetic oil (A3-2), which were prepared separately, were blended, and 4.70 parts by mass of octadecylamine and 1.15 parts by mass of cyclohexylamine were added to the base oil (A) heated to 70° C. to prepare a solution β.

Furthermore, using the grease manufacturing apparatus 1 shown in FIG. 1, the solution α heated to 70° C. was introduced from a solution introducing pipe 4A at a flow rate of 150 L/h, and the solution β heated to 70° C. was introduced from a solution introducing pipe 4B at a flow rate of 150 L/h, respectively, to a container body 2 simultaneously, and the solution α and the solution β were continuously introduced into the container body 2 in a state that the rotor 3 is rotated to synthesize the urea grease (b3).

Incidentally, the number of rotation of the rotor 3 of the grease manufacturing apparatus 1 used was 8,000 rpm. Furthermore, stirring was carried out with setting the maximum shear velocity (Max) at this time to 10,500 $s^{-1}$ and the ratio of the maximum shear velocity (Max) to the minimum shear velocity (Min) [Max/Min] to 3.5.

The urea-based thickener (B3) contained in the urea grease (b3) is corresponding to a compound represented by the general formula (b1) wherein $R^1$ and $R^2$ are selected from a cyclohexyl group and an octadecyl group, and $R^3$ is a diphenylmethylene group.

In addition, a molar ratio of octadecylamine and cyclohexylamine used as the raw materials (octadecylamine/cyclohexylamine) is 60/40.

(2) Preparation of Grease Composition

In the above-mentioned (1), the urea grease (b3) ejected from the grease manufacturing apparatus 1 shown in FIG. 1 was stirred, cooled by natural cooling, and the sarcosine derivative (C1), and the additive (E) were added at the contents shown in Table 2 to give the grease composition of Comparative Example 2.

[Requirements]

In a similar manner to the above-mentioned Example 1 and Comparative Example 1, also for the urea grease of Comparative Example 2, the particle diameter of the particles containing the urea-based thickener was calculated, and the specific surface of the particles containing the urea-based thickener was calculated.

[Evaluation of Suppression of Stick Slip]

Figure 4:
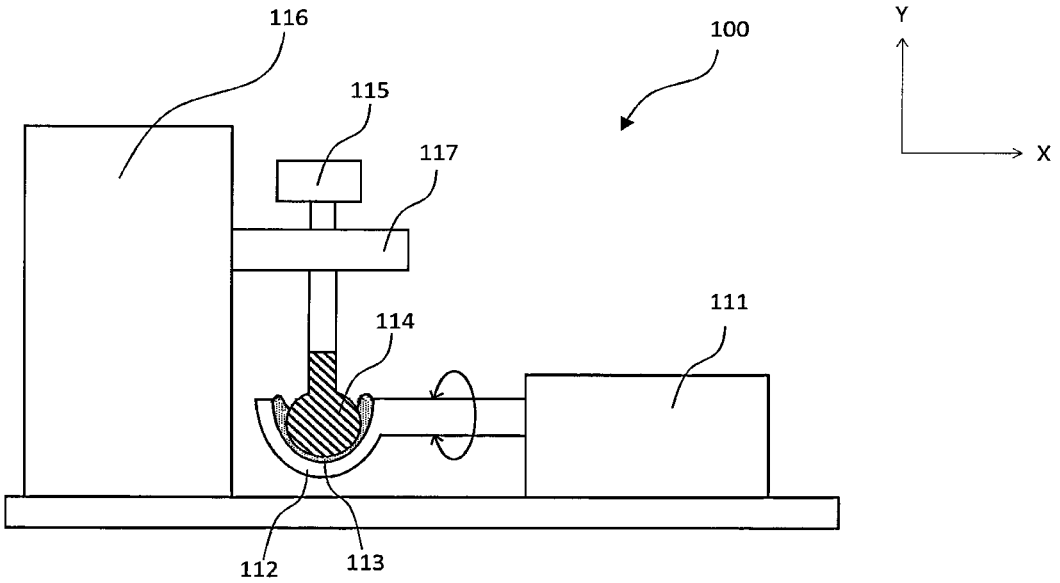
FIG. 4 is a schematic view of a measurement apparatus used for the evaluation of suppression of stick slip.

FIG. 4 is a schematic view of an apparatus used for evaluating suppression of stick slip by using a ball joint test machine.

A measuring apparatus 100 shown in FIG. 4 has a ball joint including a socket portion 112 made of a resin, and a ball portion 114 made of a metal. The socket portion 112 is connected to a servo motor 111 so as to have an axis in the direction X, and can be rotated by ±25° around the X axis. Furthermore, the ball portion 114 made of a metal has an axis in the direction Y, and is connected to an arm portion 117 of a torque cell 116. Furthermore, by modifying a load 115, an arbitrary load (maximum 10 kg) can be applied to the ball portion 114. Incidentally, the measuring apparatus 100 has a maximum frequency: 1 Hz, and a maximum measurement torque: 0.5N·m.

After applying 1 to 2 mL of a grease composition 113 so that the thickness became even inside of the socket portion 112, and the ball portion 114 made of a metal was fit to the inside of the socket portion 112, whereby the ball joint was connected to the measuring apparatus 100 as mentioned above.

Figure 5:
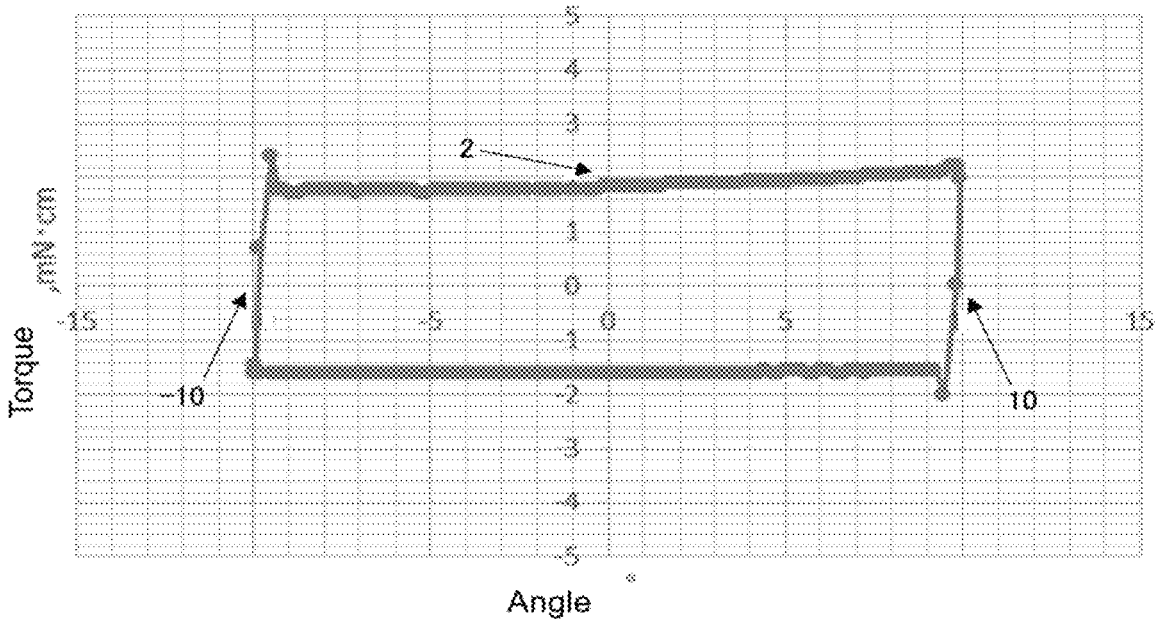
FIG. 5 is a Lissajous waveform obtained in the evaluation of the suppression of stick slip of the grease composition of Example 1.
Figure 6:
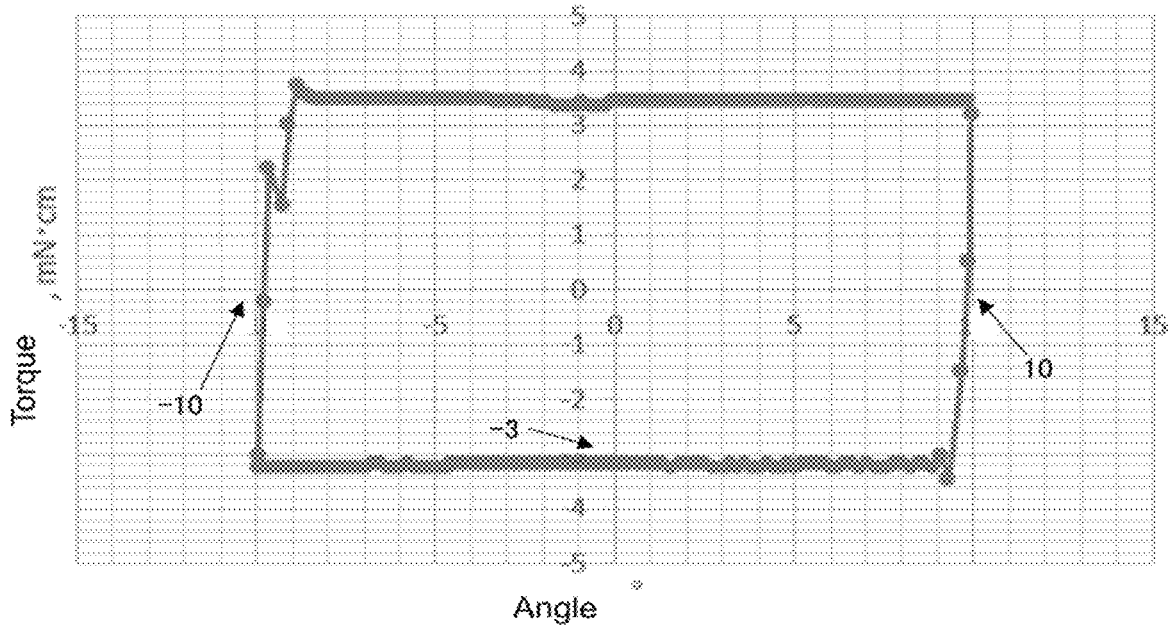
FIG. 6 is a Lissajous waveform obtained in the evaluation of the suppression of stick slip of the grease composition of Comparative Example 2.

Next, a test piece (the ball portion 114 was handled as a test piece, and was disposable) was installed in a tester under a room temperature (25° C.) environment without controlling the temperature, and after 10 minutes passed, the position where the upper surface of the socket portion 112 became horizontal was set as 0°, and the torque where the test piece was inclined from −10° to +10° around the X axis was measured under the following conditions. Waveforms were recorded for every one reciprocation of the torque with respect to an angle around the X axis, which was repeated up to ten reciprocations. The Lissajous waveforms obtained at the tenth reciprocation are shown in FIGS. 5 to 6.

From the obtained Lissajous waveform, an absolute value of the maximum torque for every one reciprocation was calculated, and an average value at ten reciprocations was obtained as a starting torque. Furthermore, an absolute value of a torque for every one reciprocation was calculated, and an average value for ten reciprocations was obtained as a constant torque. Furthermore, the degree of stick slip was evaluated according to the following evaluation criteria. Incidentally, in the following evaluation criteria, "A" or more is an enabling level.

—Conditions for Measuring Torque—

Load applied to a grease surface, including the weight of the ball portion 114: 1.0 kg Frequency: 0.1 Hz Angle: ±10° (triangle wave)

One cycle data number: 200

—Evaluation Criteria Degree of Stick Slip—

A: Stick slip appeared in the obtained Lissajous waveform, but was light.

B: An intermediate degree of stick slip appeared on the obtained Lissajous waveform.

C: A significant stick slip appeared on the obtained Lissajous waveform.

The results of evaluation of the low temperature property were shown in Table 2, and the results of evaluation of suppression of stick slip are shown in FIGS. 5 and 6.

TABLE 2

| Constitutional components (unit) | | | | Example 1 | Comparative Example 1 | Comparative Example 2 |
|---|---|---|---|---|---|---|
| Grease composition | Base oil (A) | High viscosity hydrocarbon-based synthetic oil (A1) | mass % | 41.5 | 41.5 | 34.0 |
| | | Low viscosity hydrocarbon-based synthetic oil (A2) | mass % | 11.0 | 11.0 | 21.0 |
| | | Ultra-high viscosity hydrocarbon-based synthetic oil (A3-1) | mass % | 12.5 | 12.5 | 15.0 |
| | | Ultra-high viscosity hydrocarbon-based synthetic oil (A3-2) | mass % | 6.0 | 6.0 | 10.0 |
| | Urea-based thickener (B) | Urea-based thickener (B1) | mass % | 5.0 | — | — |
| | | Urea-based thickener (B2) | mass % | — | 5.0 | — |
| | | Urea-based thickener (B3) | mass % | — | — | 10.0 |
| | Sarcosine derivative (C) | Sarcosine derivative (C1) | mass % | 3.0 | 3.0 | 3.0 |
| | Fatty acid zinc salt (D) | Fatty acid zinc salt (D1) | mass % | 15.5 | 15.5 | — |
| | Additive (E) | Additive (E) | mass % | 5.5 | 5.5 | 7.0 |
| Total | | | mass % | 100.0 | 100.0 | 100.0 |
| Base oil (A) | Base oil (A) Total | | mass % | 71.0 | 71.0 | 80.0 |
| | [Base oil(A1)/Base oil (A) Total] | | mass % | 58.5 | 58.5 | 42.5 |
| | [Base oil(A2)/Base oil (A) Total] | | mass % | 15.5 | 15.5 | 26.3 |
| | [Base oil(A3)/Base oil (A) Total] | | mass % | 26.1 | 26.1 | 31.3 |
| | Content ratio of base oils [(A1)/(A2)] | | — | 3.8 | 3.8 | 1.6 |
| | Content ratio of base oils [(A3)/(A2)] | | — | 1.7 | 1.7 | 1.2 |
| | Content ratio of base oils [(A1)/(A3)] | | — | 2.2 | 2.2 | 1.4 |
| Content ratio [(B)/(D)] | | | — | 0.3 | 0.3 | — |
| Content ratio [(C)/(D)] | | | — | 0.2 | 0.2 | — |
| Physical property values | Base oil (A) (Blended base oil) | 40° C. kinematic viscosity | $mm^2/s$ | 1074 | 1074 | 1074 |
| | | 100° C. kinematic viscosity | $mm^2/s$ | 97 | 97 | 97 |
| | | Viscosity index | — | 180 | 180 | 180 |
| | Urea-based thickener (B) | Arithmetic average particle diameter of particles | μm | 0.33 | 132 | 0.28 |
| | | Specific surface area of particles | $cm^2/cm^3$ | $1.8 \times 10^5$ | $7.1 \times 10^4$ | $2.0 \times 10^5$ |
| | Grease composition | Worked penetration | — | 317 | 325 | 278 |
| | | Dropping point | ° C. | 210 | 212 | Greater than 250 |
| Content of zinc atom derived from fatty acid zinc salt (D1) in grease composition | | | mass % | 1.7 | 1.7 | 0.0 |
| Evaluation result | Suppression of stick slip | Starting torque | mN · m | 3.19 | 3.71 | 4.28 |
| | | Constant torque | mN · m | 2.19 | 2.73 | 3.48 |
| | | Degree of stick slip | — | A | B | C |

The results shown in Table 2 and FIGS. 5 and 6 reveals as follows.

In Comparative Example 2, stick slip occurred in the vicinity of an angle around X axis of −10°, and the evaluation was "C". Although not depicted, an intermediate degree of stick slip occurred in Comparative Example 1, and the evaluation was "B". Furthermore, at least one of the starting torque and constant torque had a high value exceeding 3.40.

On the other hand, in the grease composition of Example 1, the degree of stick slip was small, and the evaluation was "A", and the starting torque and constant torque were smaller than those of Comparative Examples 1 and 2.

REFERENCE SIGNS LIST

1: Grease manufacturing apparatus
2: Container body
3: Rotor
4: Introduction portion
4A, 4B: Solution introducing pipe
5: Retention portion
6: First concave-convex portion
7: Second concave-convex portion
8: Discharge portion
9: First concave-convex portion on the side of container body
10: Second concave-convex portion on the side of container body
11: Discharge port
12: Rotation axis
13: First concave-convex portion of rotor
13A: Concave portion
13B: Convex portion
14: Second concave-convex portion of rotor
15: Scraper
A1, A2: Gap

The invention claimed is:

1. A grease composition, comprising:
a base oil (A);
a urea-based thickener (B);
a sarcosine derivative (C); and
a fatty acid zinc salt (D);
wherein particles comprising the urea-based thickener (B) in the grease composition have an arithmetic average particle diameter on an area basis as measured by a laser diffraction/scattering method is 2.0 μm or less,
wherein the fatty acid zinc salt (D) is present in a range of from 10 to 20 mass%, based on a total grease composition mass,
wherein the base oil (A) has a 40° C. kinematic viscosity is in a range of from 500 $mm^2/s$ to 1,500 $mm^2/s$,
wherein the base oil (A) has a viscosity index of 140 or more, and
wherein the base oil (A) is a blended base oil comprising
a high viscosity hydrocarbon-based synthetic oil (A1) having a 40° C. kinematic viscosity in a range of from 200 $mm^2/s$ to 600 $mm^2/s$;
a low viscosity hydrocarbon-based synthetic oil (A2) having a 40° C. kinematic viscosity in a range of from 5.0 to 110 $mm^2/s$; and
an ultra-high viscosity hydrocarbon-based synthetic oil (A3) having a number average molecular weight (Mn) in a range of from 2,500 to 4,500 and a 40° C. kinematic viscosity in a range of from 25,000 to 50,000 $mm^2/s$.

2. The grease composition of claim 1, wherein the particles comprising the urea-based thickener (B) in the grease composition further
have a specific surface area as measured by the laser diffraction/scattering method of $0.5\times10^5$ $cm^2/cm^3$ or more.

3. The grease composition of claim 1, wherein a (C)/(D) mass content ratio of the sarcosine derivative (C) to the fatty acid zinc salt (D) is in a range of from 0.03 to 0.3.

4. The grease composition of claim 1, wherein the sarcosine derivative (C) comprises N-oleoylsarcosine.

5. The grease composition of claim 1, wherein the fatty acid zinc salt (D) comprises zinc stearate.

6. The grease composition of claim 1, wherein a (B)/(D) mass content ratio of the urea-based thickener (B) to the fatty acid zinc salt (D) is in a range of from 0.1 to 0.6.

7. The grease composition of claim 1, comprising the urea-based thickener (B) in a range of from 1.0 to 15.0 mass %, based on a total grease composition mass, and
wherein a worked penetration of the grease composition is in a range of from 265 to 340.

8. The grease composition of claim 1, comprising, based on the total grease composition mass:
the high viscosity hydrocarbon-based synthetic oil (A1) in a range of from 25 to 55 mass %;
the low viscosity hydrocarbon-based synthetic oil (A2) in a range of from 5 to 35 mass %; and
the ultra-high viscosity hydrocarbon-based synthetic oil (A3) in a range of from 5 to 30 mass %.

9. The grease composition of claim 1, wherein an (A1)/(A2) mass content ratio of the high viscosity hydrocarbon-based synthetic oil (A1) to the low viscosity hydrocarbon-based synthetic oil (A2) is in a range of from 0.5 to 12.

10. The grease composition of claim 1, wherein an (A3)/(A2) mass content ratio of the low viscosity hydrocarbon-based synthetic oil (A3) to the ultra-high viscosity hydrocarbon-based synthetic oil (A2) is in a range of from 1.0 to 10.

11. The grease composition of claim 1, wherein an (A1)/(A3) mass content ratio of the high viscosity hydrocarbon-based synthetic oil (A1) to the ultra-high viscosity hydrocarbon-based synthetic oil (A3) is in a range of from 1.0 to 11.

12. A method for lubricating a sliding mechanism, the method comprising:
sliding a metal material and a resin material with the grease composition of claim 1.

13. The method according toof claim 12, wherein the sliding mechanism is a ball joint having a ball stud made of a metal, a housing, and a ball sheet made of a resin disposed between the ball stud and the housing.

14. The grease composition of claim 1, wherein the arithmetic average particle diameter of the particles on an area basis as measured by a laser diffraction/scattering method is 1.5 μm or less.

15. The grease composition of claim 1, wherein the arithmetic average particle diameter of the particles on an area basis as measured by a laser diffraction/scattering method is 1.0 μm or less.

16. The grease composition of claim 1, wherein the arithmetic average particle diameter of the particles on an area basis as measured by a laser diffraction/scattering method is in a range of from 1.5 to 0.01 μm.

17. The grease composition of claim 1, wherein the specific surface area of the particles as measured by the laser diffraction/scattering method is $0.8\times10^5$ $cm^2/cm^3$ or more.

18. The grease composition of claim 1, wherein the specific surface area of the particles as measured by the laser diffraction/scattering method is $1.2\times10^5$ $cm^2/cm^3$ or more.

19. The grease composition of claim 1, wherein the specific surface area of the particles as measured by the laser diffraction/scattering method is in a range of from $0.8\times10^5$ to $1.0\times10^6$ $cm^2/cm^3$.

20. The grease composition of claim 1, wherein the high viscosity hydrocarbon-based synthetic oil (A1) has a 40° C. kinematic viscosity in a range of from 250 $mm^2/s$ to 550 $mm^2/s$, wherein the low viscosity hydrocarbon-based synthetic oil (A2) having a 40° C. kinematic viscosity in a range of from 6.0 to 90 $mm^2/s$, and an ultra-high viscosity hydrocarbon-based synthetic oil (A3) having a number average molecular weight (Mn) in a range of from 3,000 to 4,250 and a 40° C.kinematic viscosity in a range of from 30,000 to 45,000 $mm^2/s$.

* * * * *